US009821246B2

(12) United States Patent
Rieber

(10) Patent No.: US 9,821,246 B2
(45) Date of Patent: Nov. 21, 2017

(54) PLAY CENTER

(71) Applicant: SOLOWAVE DESIGN LP, Waterloo, Ontario (CA)

(72) Inventor: Frederick M. Rieber, Hamburg, NY (US)

(73) Assignee: SOLOWAVE DESIGN LP, Waterloo (CA)

( * ) Notice: Subject to any disclaimer, the term of this patent is extended or adjusted under 35 U.S.C. 154(b) by 73 days.

(21) Appl. No.: 14/812,959

(22) Filed: Jul. 29, 2015

(65) Prior Publication Data

US 2016/0030855 A1 Feb. 4, 2016

Related U.S. Application Data

(60) Provisional application No. 62/031,057, filed on Jul. 30, 2014.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |
| ***A63H 33/10*** | (2006.01) |
| ***A63G 31/00*** | (2006.01) |
| *E04B 2/74* | (2006.01) |
| *B44C 5/04* | (2006.01) |

(Continued)

(52) U.S. Cl.

CPC ..... *A63H 33/10* (2013.01); *A63G 31/00* (2013.01); *A63H 33/008* (2013.01); *A63H 33/04* (2013.01); *A63H 33/08* (2013.01); *B44C 5/04* (2013.01); *E01F 8/0011* (2013.01); *E04B 1/6141* (2013.01); *E04B 1/6145* (2013.01); *E04B 2/7425* (2013.01); *E04H 17/16* (2013.01); *E04H 17/168* (2013.01); *G09F 15/0012* (2013.01); *G09F 15/0068* (2013.01)

(58) Field of Classification Search

CPC ..... B44C 5/04; E04H 17/16; E04H 17/168; E04B 2/7425; E04B 1/6145; E04B 1/6141; G09F 15/0068; G09F 15/0012; E01F 8/0011; A63H 33/04; A63H 33/008; A63H 33/08; A63H 33/10; A63H 33/00

USPC ..... 52/206, 578, 204.1, 456, 475.1, 656.8, 52/79.9; 472/136; 446/476; 29/428

See application file for complete search history.

(56) References Cited

U.S. PATENT DOCUMENTS 5,078,367 A * 1/1992 Simpson ..... E01F 8/0011 256/19

5,179,810 A * 1/1993 Gename ..... E04B 2/7409 160/135

(Continued)

*Primary Examiner* — Chi Q Nguyen

(74) *Attorney, Agent, or Firm* — Matthew A. Pequignot; Pequignot + Myers LLC

(57) ABSTRACT

A play center including a number of frames secured to each other to at least partially define substantially vertical walls of the outdoor play center, each frame having two or more openings, and a number of panels, each panel having a body thereof, the panels being receivable in selected ones of the openings. Each of the openings is partially defined by one or more elongate side walls of each frame. Each panel includes one or more flanges extending from the body over at least a receiving portion of the side wall. The play center also includes a number of fasteners for fastening the flanges to the receiving portions.

18 Claims, 22 Drawing Sheets

(51) Int. Cl.

| | |
|---|---|
| *E04H 17/16* | (2006.01) |
| *E04B 1/61* | (2006.01) |
| *G09F 15/00* | (2006.01) |
| *A63H 33/04* | (2006.01) |
| *E01F 8/00* | (2006.01) |
| *A63H 33/08* | (2006.01) |
| *A63H 33/00* | (2006.01) |

(56) References Cited

U.S. PATENT DOCUMENTS

| | | | | |
|---|---|---|---|---|
| 5,842,927 | A * | 12/1998 | Rieber | A63G 21/02 104/69 |
| 6,178,978 | B1 * | 1/2001 | Rieber | E04H 15/006 135/147 |
| 6,892,497 | B2 * | 5/2005 | Moon | E04H 1/1205 52/270 |
| 7,395,634 | B2 * | 7/2008 | Anderson | E04H 1/1205 52/264 |
| 7,815,513 | B2 * | 10/2010 | Rieber | A63G 21/10 285/411 |
| 8,046,965 | B2 * | 11/2011 | Rieber | E04H 17/16 52/210 |
| 8,382,602 | B2 * | 2/2013 | Rieber | A63G 21/10 472/116 |
| 8,777,767 | B2 | 7/2014 | Kopp et al. | |
| 2004/0244317 | A1 * | 12/2004 | Tan | E04B 2/7425 52/204.1 |
| 2007/0251179 | A1 * | 11/2007 | McCarthy | B44C 3/12 52/578 |
| 2014/0155182 | A1 | 6/2014 | DeBlanco et al. | |
| 2014/0315651 | A1 | 10/2014 | Meister et al. | |

* cited by examiner

PLAY CENTER

CROSS REFERENCE TO RELATED APPLICATIONS

This application claims priority to U.S. Provisional Application No. 62/031,057, filed on Jul. 30, 2014, the entirety of which is hereby incorporated by reference.

FIELD OF THE INVENTION

The present invention is a play center including a number of frames and a number of panels positioned in the frames.

BACKGROUND OF THE INVENTION

Various play centers are known. Typically, components of the play center are manufactured in a factory and then shipped, with instructions, for assembly by the consumer. In general, the components needed for a particular play center are included in a package.

Designers of play centers are required to address a number of conflicting priorities. For example, although consumers generally want a number of features (e.g., swings) that will be of interest to children, not all consumers are willing to pay for numerous features, i.e., some consumers prefer a basic play center, with limited features. On the other hand, however, consumers typically prefer to have an individually-tailored play center.

However, in addition to the demand for more features and greater scope for individuality of design, there is also a demand for competitive pricing. The limits on pricing tend to limit the number of elements sold, and also has other impacts. For example, shipping costs tend to be significant, so designers typically attempt to find a balance between the need to limit shipping costs and the competing demands for more features. Safety issues also need to be taken into account.

The known play centers have various disadvantages, for example, a consumer usually has only a limited selection of designs from which to choose. Typically, one package of components will provide only one play center having a particular design. In general, individually tailoring a particular design based on the components supplied in a standard package is not possible.

SUMMARY OF THE INVENTION

There is a need for a play center that overcomes or mitigates one or more of the defects or disadvantages of the prior art. Such disadvantages or defects are not necessarily included in those listed above.

In its broad aspect, the invention provides a play center including a number of walls, and a number of wall fasteners securing the walls to each other. Each wall includes one or more wall subassemblies. The wall subassembly includes a frame selected from the group consisting of at least a first frame and a second frame. The frame includes parallel side walls defining respective left and right sides thereof and top and bottom cross-members defining respective top and bottom ends thereof, each said frame having an overall height between the top and bottom ends thereof. The first frame has an overall first width between the left and right sides thereof, and the second frame has an overall second width between the left and right sides thereof, the overall second width being greater than the overall first width.

In one aspect, each of the frames includes one or more openings having predetermined dimensions in which one or more panels are receivable.

In another of its aspects, the wall subassembly includes one or more panels positioned in a selected one of the openings in the frame.

In another of its aspects, the invention provides a play center including a number of frames secured to each other to at least partially define substantially vertical walls of the outdoor play center, each frame having two or more openings therein. The play center also includes a number of panels, each panel including a body thereof, the panels being receivable in selected ones of the openings. Each of the openings is partially defined by one or more elongate side walls of the frame. Each panel also includes one or more flanges extending from the body over at least a receiving portion of the side wall. The play center also includes a number of fasteners for fastening the flanges to the receiving portion of the side wall.

In yet another of its aspects, the invention provides a kit of parts for a play center including a number of frames, the frames being sized to be secured together to form walls of the play center, each frame including two or more openings. The kit also includes a number of panels, each panel being formed to be received in a selected one of the openings, and a number of wall fasteners, for securing the frames together to form the walls of the play center.

In another aspect, the invention provides a play center including a number of walls, and a number of wall fasteners securing the walls to each other. Each wall includes one or more wall subassemblies. The wall subassembly includes a frame selected from the group consisting of a first frame, a second frame, and a third frame. Each of the frames has parallel side walls defining respective left and right sides thereof and top and bottom cross-members defining respective top and bottom ends thereof, and each of the frames has an overall height between the top and bottom ends thereof. The first frame has an overall first width between the left and right sides thereof, and each of the second and third frames has an overall second width between the left and right sides thereof that is greater than the overall first width.

In another aspect, each of the frames includes two or more openings therein at least partially defined by an intermediate cross-member of each frame respectively, the intermediate cross-member connecting the side walls and being positioned between the top and bottom cross-members. The two openings at least partially defined by the intermediate cross-member of each frame include one or more upper openings between the intermediate and the top cross-members, and a lower opening between the intermediate and the bottom cross-members.

In another aspect, each of the upper openings in the first frame is sized to receive a first upper panel and the lower opening in the first frame is sized to receive a first lower panel respectively. The upper opening in the second frame is sized to receive a second upper panel and the lower opening in the second frame is sized to receive a second lower panel respectively. The third frame includes two upper openings, each upper opening being sized to receive the first upper panel respectively. The two upper openings are at least partially defined by a central member and the intermediate cross-member. The lower opening in the third frame is sized to receive the second lower panel.

In another of its aspects, the first lower panels and first upper panels and the second lower panels and second upper panels include respective bodies thereof, and the first lower panels and upper panels and the second lower panels and upper panels include respective side wall flanges that extend from each body respectively over at least a side receiving portion of each of the side walls, the side wall flanges being securable to the respective side walls by panel fasteners.

In another aspect, the side receiving portions of the side walls are located on respective interior sides of the side walls, each interior side including one or more proud regions, and each side receiving portion being recessed relative to the one proud region.

In another aspect, the invention provides one or more upper jamb board subassemblies, each having an upper jamb board for dividing the upper opening in the second frame into two modified upper openings sized for receiving two of the first upper panels therein respectively.

In yet another of its aspects, the invention additionally provides one or more lower jamb board subassemblies, each having a lower jamb board for dividing each of the lower openings in the second frame and the third frame respectively into two modified lower openings sized for receiving two of the first lower panels therein respectively.

In another aspect, when the first upper panel is positioned beside an upper central dividing element selected from the group consisting of the upper jamb board and the central member, a first selected one of the side wall flanges of the first upper panel extends from the body of the first upper panel over an upper central receiving portion of the upper central dividing element, and the first selected one of the side wall flanges is attached to the central dividing element by the panel fasteners.

In yet another aspect, when the first lower panel is positioned beside the lower jamb board, a second selected one of the side wall flanges of the first lower panel extends from the body of the first lower panel over a lower central receiving portion of the lower jamb board, and the second selected one of the side wall flanges is attached to the lower jamb board by the panel fasteners.

In another of its aspects, the invention provides a method of constructing a play center, the method including providing a number of frames securable to each other to at least partially define substantially vertical walls, each frame including one or more upper openings and one or more lower openings. A number of panels are provided that are sized to be received in selected ones of the upper openings and the lower openings respectively, each panel having a body and one or more flanges extending from the body. A number of panel fasteners are provided for securing the flanges to the frames, to secure the panels to the frames respectively. Selected ones of the panels are positioned in selected ones of the upper openings and the lower openings in selected ones of the frames respectively to locate the panels in a predetermined arrangement relative to each other, when the frames are secured to each other. The selected ones of the panels are fastened to the selected ones of the frames respectively. Using wall fasteners, the frames are secured to each other to form substantially vertical walls of the play center. Using the wall fasteners, the walls are secured together to form the play center.

BRIEF DESCRIPTION OF THE DRAWINGS

The invention will be better understood with reference to the attached drawings, in which.

DETAILED DESCRIPTION

Figure 10:
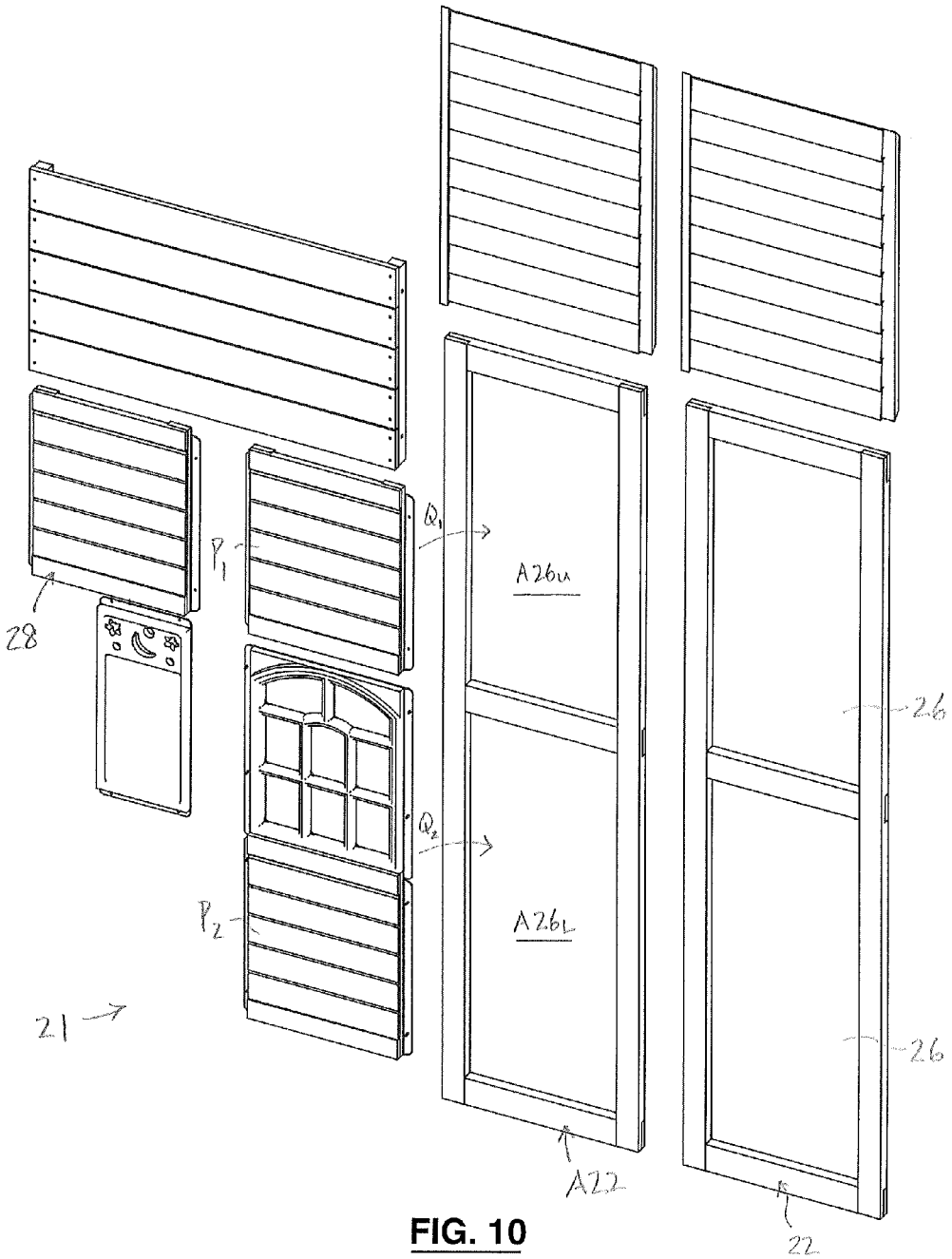
FIG. 10 is an exploded view of the components of another embodiment of the play center of the invention.
Figure 11:
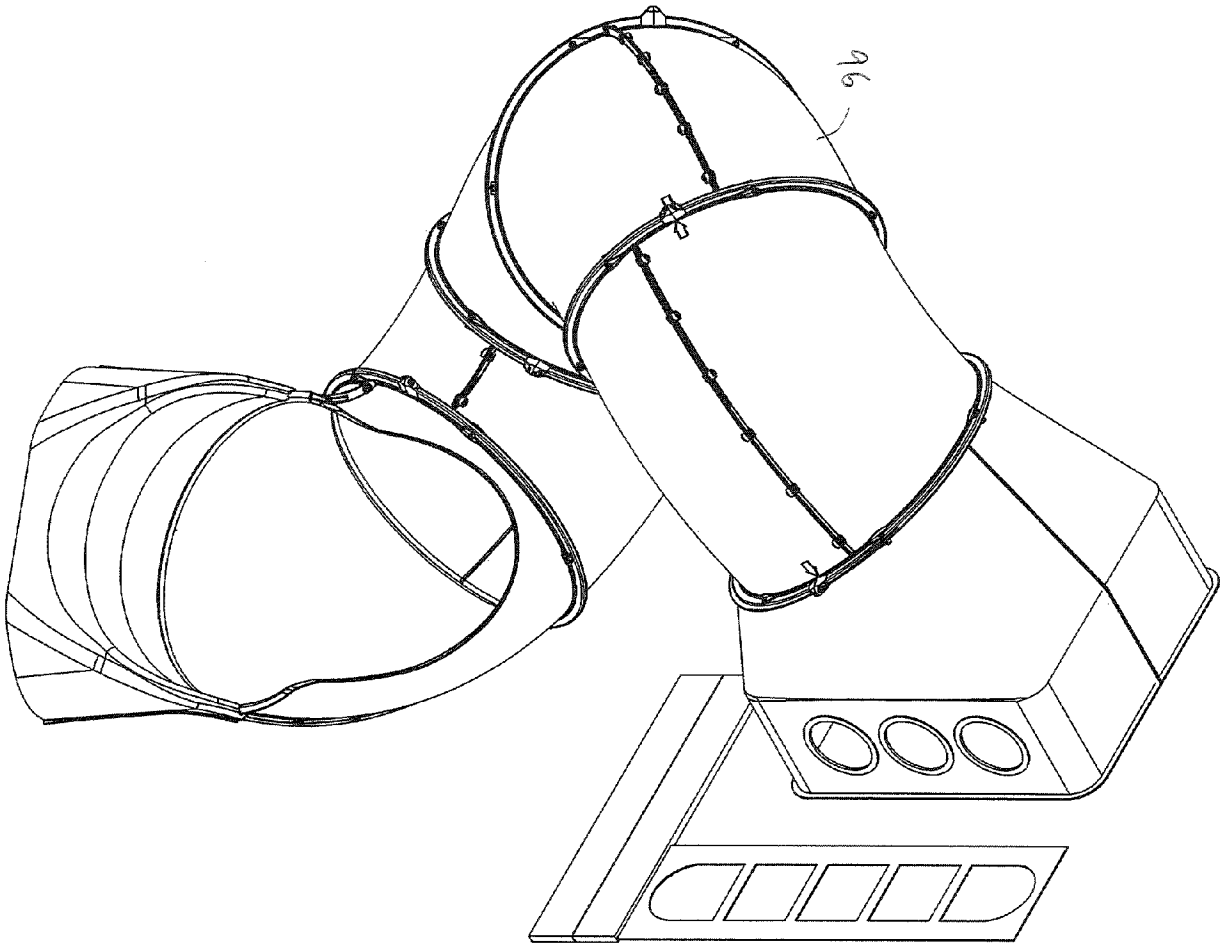
FIG. 11 is a slide subassembly, drawn at a larger scale.
Figure 12:
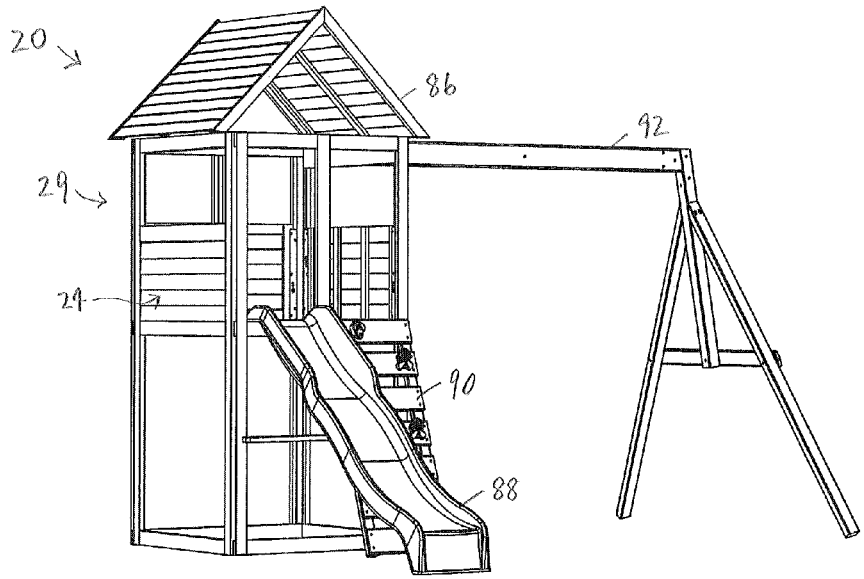
FIG. 12 is an isometric view of an embodiment of the play center of the invention, drawn at a smaller scale.
Figure 13:
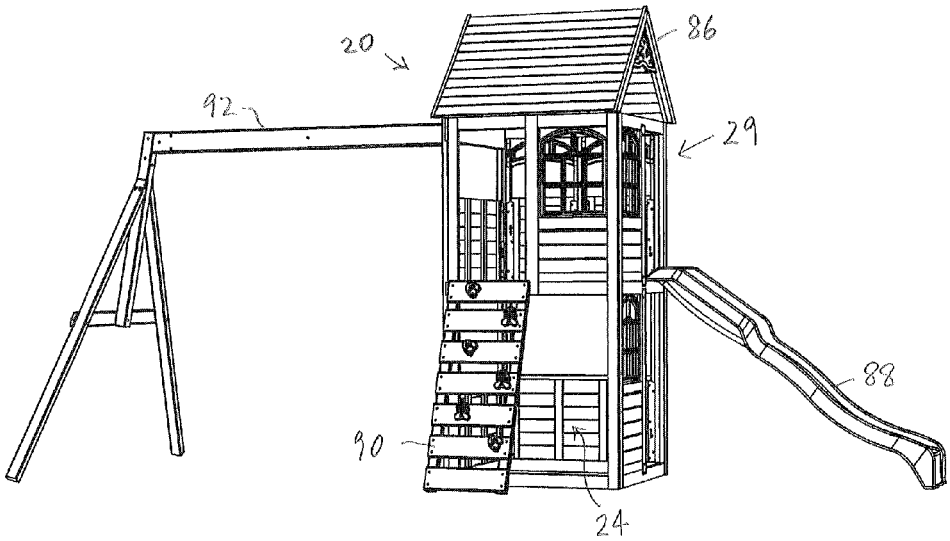
FIG. 13 is an isometric view of another embodiment of the play center of the invention.

In the attached drawings, like reference numerals designate corresponding elements throughout. Reference is first made to FIGS. 1A-15 to describe an embodiment of a play center of the invention indicated generally by the numeral 20 (FIGS. 12, 13). In one embodiment, a kit of parts 21 for the play center 20 is provided (FIGS. 8A, 8B). Preferably, the kit 21 includes a number of frames 22 (FIGS. 8A, 8B, 10), the frames 22 being sized to be secured together to form walls 24 of the play center 20 (FIGS. 12, 13). As will be described, each of the frames 22 preferably includes two or more openings 26 (FIGS. 8A, 8B, 10). It is also preferred that the kit 21 includes a number of panels 28 (FIGS. 8A, 8B, 10), each panel 28 being formed to be received in a selected one of the openings 26. The kit 21 preferably also includes a number of wall fasteners 30 (FIG. 15), for securing the frames 22 together to form the walls 24 of the play center 20.

It will be understood that, once the walls 24 are secured together, a standalone, main structure 29 is formed. The play center 20, once assembled, may consist of the main structure 29. However, as can be seen, for example, in FIGS. 12-20, the play center 20 may include a number of additional elements that may be attached to the main structure 29, as will be described.

Embodiments of the kit 21 of the invention are illustrated in FIGS. 8A and 8B. It will be understood that the embodiments shown in FIGS. 8A and 8B are exemplary only. Those skilled in the art would appreciate that one of the kits 21 may include only such components as may be desired by a purchaser, to provide the play center with such features as the purchaser seeks, for the enjoyment of users of the assembled play center 20. The components of the kit 21 therefore may be any components that may be assembled into the freestanding play center 20.

It is preferred that the play center 20 includes the frames 22 having predetermined dimensions, defining the openings 26 therein, which have preselected dimensions. The panels 28 are also standardized in their sizes (i.e., the panels 28 have preselected dimensions) to fit into the openings, but may include a wide variety of elements, for the benefit of those who will use the play center 20 once assembled. As will be described, the frames 22 are provided only in certain sizes, i.e., the predetermined dimensions thereof are limited to only certain sizes of frames. The frames 22 define openings 26 therein that have only certain predetermined configurations, as will be described. Similarly, the preselected dimensions of the panels 28 are limited to only certain sizes of panels 28, formed to fit into certain of the openings 26 respectively.

Preferably, the purchaser of the kit 21 selects the components that he wishes to have included in the play center 20, once the play center is assembled. The kit, including only the desired components, may be shipped to the purchaser, or picked up by the purchaser at a retail store. It is anticipated that the play center is then assembled at the location where it is to be used, in accordance with instructions provided with the unassembled play center. The same components may be assembled in many different ways. Preferably, the play center is intended to be assembled by the purchaser with few tools, and it is assumed that the purchaser is generally unskilled and has only limited, basic tools.

Those skilled in the art would appreciate that the assembled play center may have a wide variety of configurations. For instance, the assembled play center 20 may only have four walls 24 arranged to define the structure 29, having a generally rectangular or square footprint. As noted above, however, and as will be described, the play center 20 may include additional, optional, elements that are attached to the structure 29 after the structure 29 has been erected (FIGS. 12-20). Examples of the play center 20 with certain additional elements can be seen in FIGS. 12-20.

Because of the standardized frames and panels, the manufacturing and shipping costs incurred in connection with providing the kit for the play center are reduced. However, and as will be described, the frames 22 preferably are varied (notwithstanding the high degree of standardization thereof) to permit a variety of panels 28 (that are also standardized to a high degree) to be positioned in the openings in the frames 22, thereby providing a large number of options to the purchaser regarding the appearance and functional features of the play center 20.

Figure 1C:
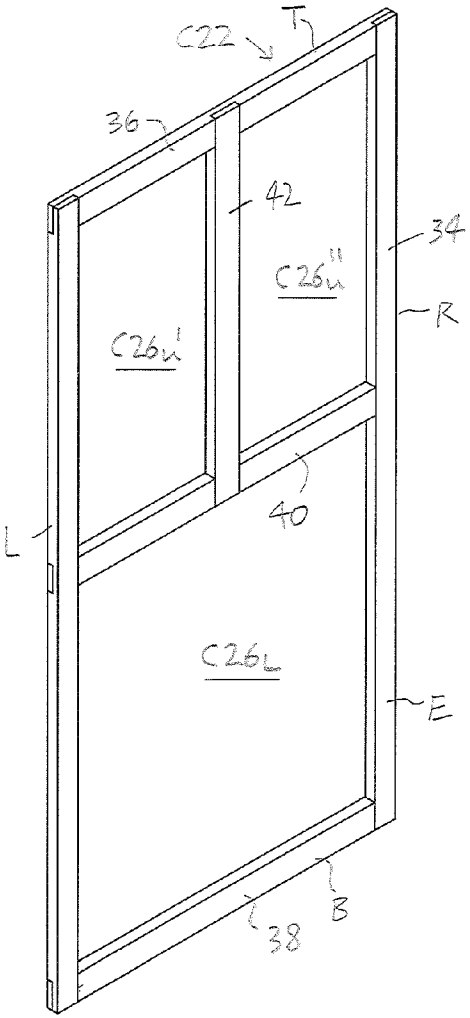
FIG. 1C is an isometric view of an exterior side of another embodiment of the frame of the invention.
Figure 1B:
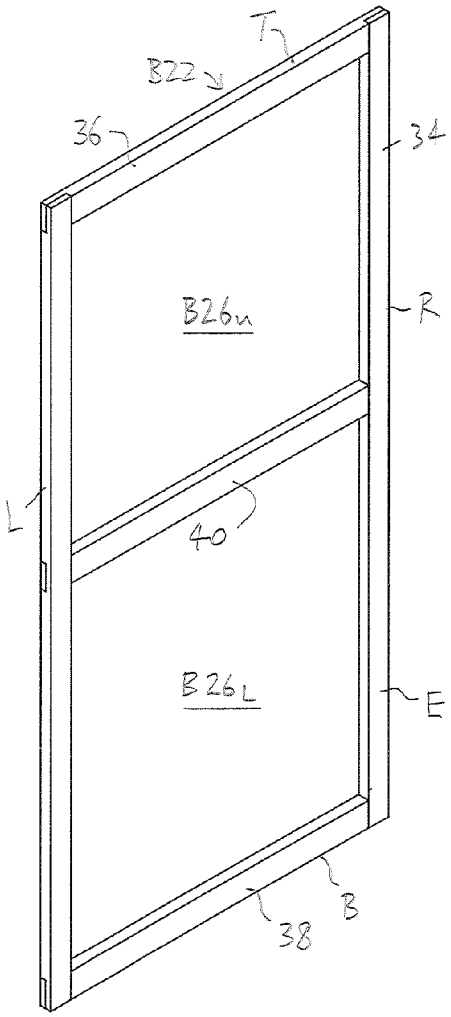
FIG. 1B is an isometric view of an exterior side of another embodiment of the frame of the invention.
Figure 1A:
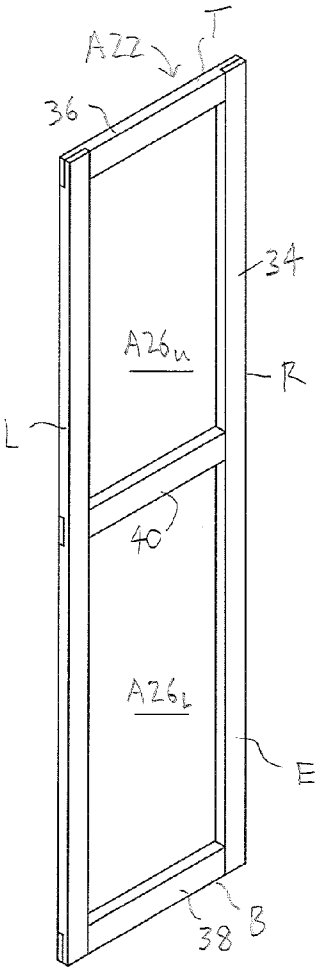
FIG. 1A is an isometric view of an exterior side of an embodiment of a frame of the invention.
Figure 2C:
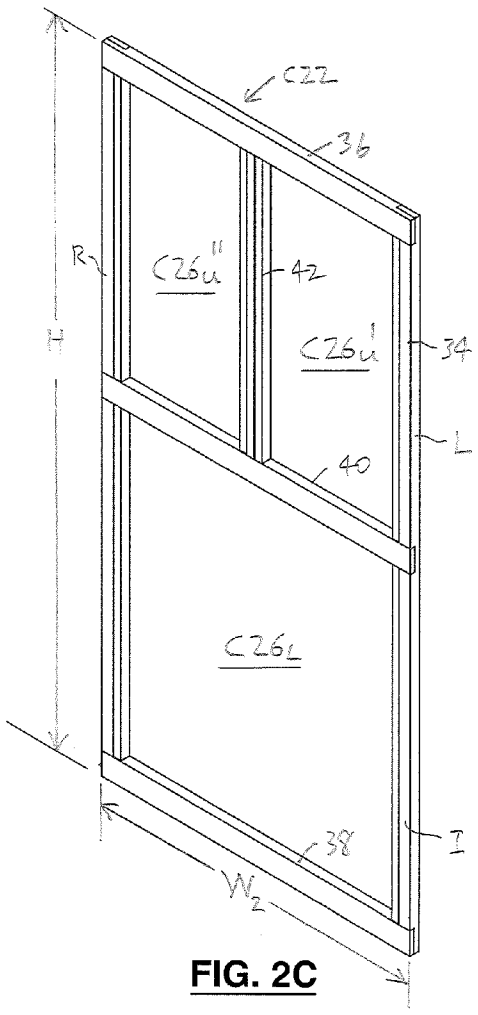
FIG. 2C is an isometric view of an interior side of the frame of FIG. 1C.
Figure 2B:
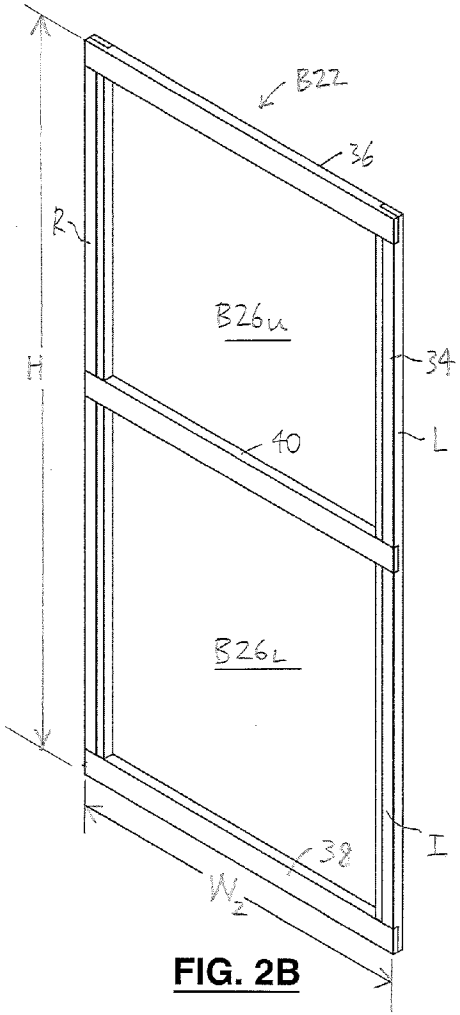
FIG. 2B is an isometric view of an interior side of the frame of FIG. 1B.
Figure 2A:
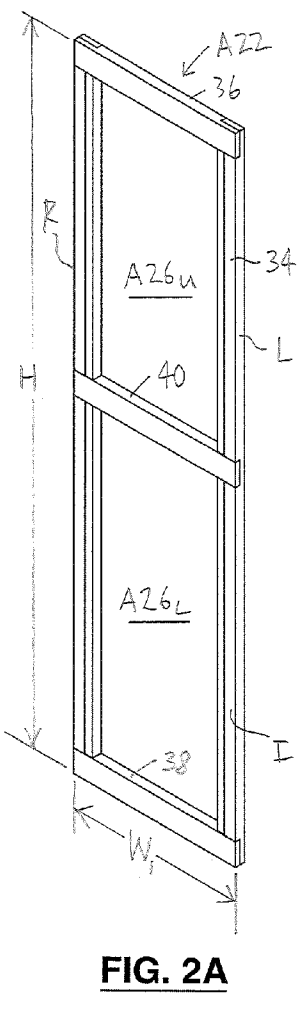
FIG. 2A is an isometric view of an interior side of the frame of FIG. 1A.
Figure 14:
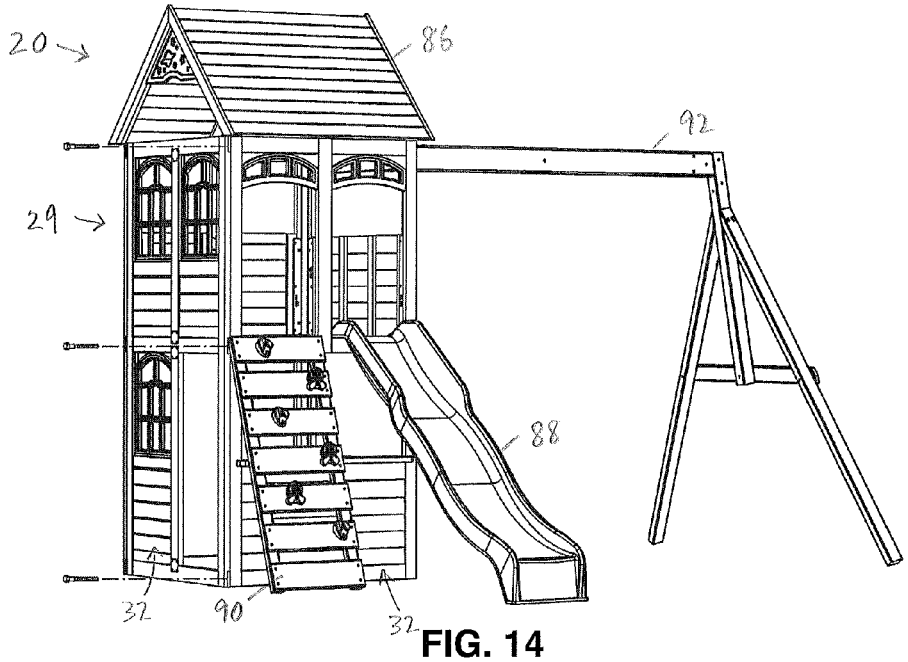
FIG. 14 is an isometric view of another embodiment of the play center of the invention.
Figure 15:
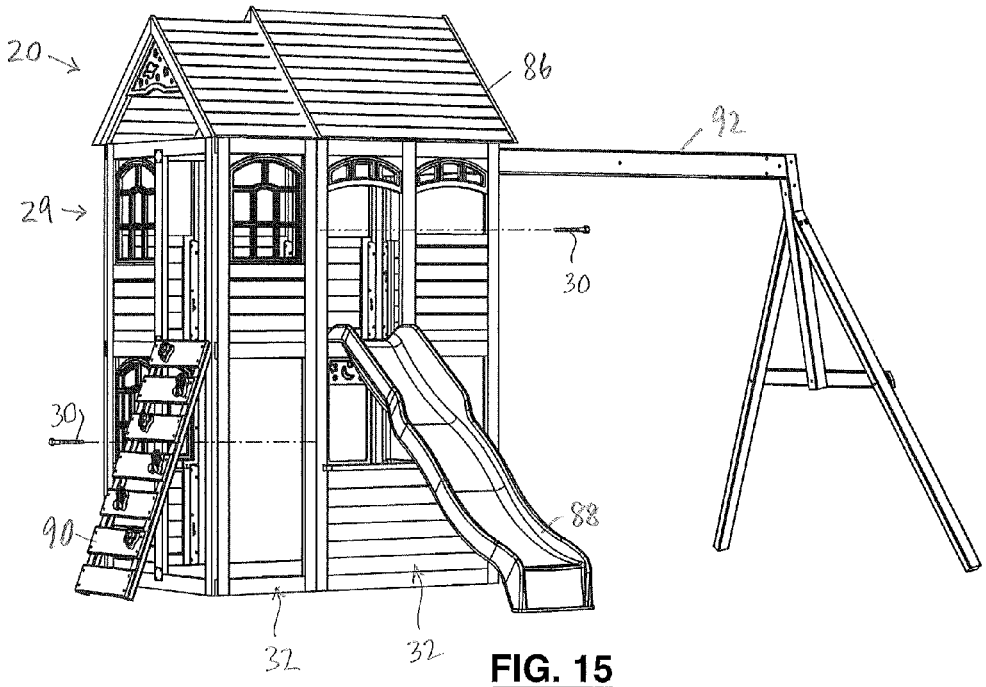
FIG. 15 is an isometric view of another embodiment of the play center of the invention.

In one embodiment, the play center 20 preferably includes a number of the walls 24 and a number of the wall fasteners 30 securing the walls 24 to each other (FIGS. 14, 15). In one embodiment, each of the walls 24 preferably includes one or more wall subassemblies 32 (FIGS. 6D, 7A, 14, 15). The wall subassembly 32 preferably includes the frame 22, which is selected from the group consisting of a first frame A22, a second frame B22, and a third frame C22, as will be described (FIGS. 1A-1C). It will be understood that the wall subassembly 32 preferably includes any one of the three standard frames, i.e., any one of the frames A22, B22, and C22. As can be seen in FIG. 6A, it is preferred that each frame 22 includes substantially parallel side walls 34 defining respective left and right sides thereof (designated "L" and "R" in FIGS. 1A-2C) and top and bottom cross-members 36, 38 defining respective top and bottom ends (designated "T" and "B" respectively in FIGS. 1A-1C) thereof. Each of the frames 22 has an overall height ("H") between the top and bottom ends "T", "B" thereof (FIGS. 2A-2C). As can be seen in FIGS. 2A-2C, the first frame A22 preferably has an overall first width "$W_1$" between the left and right sides thereof, and each of the second and third frames B22, C22 preferably has an overall second width "$W_2$" between the left and right sides thereof that is greater than the overall first width "$W_1$".

It will be understood that exterior sides "E" of the frames A22, B22, and C22 are illustrated in FIGS. 1A-1C. Also, interior sides "I" of the frames A22, B22, and C22 are illustrated in FIGS. 2A-2C. As will be described, the panels 28 preferably are inserted into the openings 26 from the interior sides "I", and secured to the interior sides "I" of the frames A22, B22, and C22.

Because the frames A22, B22, C22 all have substantially the same overall height "H", assembly of the play center 20 is simplified. The frame A22 has an overall width "$W_1$" that differs from the overall width "$W_2$" of each of the second and third frames B22, C22 so that panels 28 of different sizes may be accommodated in the frames A22, B22, C22, as will also be described. Those skilled in the art would appreciate that limiting the types of frames to three facilitates standardization of various elements of the play center (e.g., the panels). The panels are required to fit in the openings in the frames, and the openings are formed to have only certain dimensions, as will be described. However, a wide variety of panels may be used, and therefore the panels may be selected and positioned to provide a pleasing or interesting appearance, and to provide a variety of functional features. As can be seen in FIG. 7A, in one embodiment, a panel preferably does not occupy the entire opening in which it is positioned. In other embodiments, the panel preferably occupies substantially the entire opening.

Also, in another embodiment, the wall subassembly 32 preferably is provided, and included in one of the walls 24, without including one or more of the panels therein. That is, in the wall subassembly 32, one or more of the openings 26 in the frame 22 thereof may be unoccupied, if preferred. Examples of this may be seen, for example, in FIG. 12.

In one embodiment, each of the frames 22 preferably includes two or more of the openings 26 therein at least partially defined by an intermediate cross-member 40 of each of the frames 22 respectively. As can be seen in FIGS. 1A-2C, the intermediate cross-member 40 in the frame 22 preferably connects the side walls 34 thereof, and is positioned between the top and bottom cross-members 36, 38 thereof.

As can be seen in FIGS. 1A, 1B, 2A, and 2B, it is preferred that the two or more openings 26 at least partially defined by the intermediate cross-member 40 of the frame 22 include one or more upper openings between the intermediate cross-member 40 and the top cross-member 36, and a lower opening between the intermediate cross-member 40 and the bottom cross-member 38. As noted above, the openings preferably are formed to have only certain dimensions, and the panels receivable therein are formed accordingly. For instance, as can be seen in FIGS. 1A, 2A, and 10, an upper opening A26$_U$ in the first frame A22 is sized to receive a first upper panel A28$_U$ and a lower opening A26$_L$ in the first frame A22 is sized to receive a first lower panel A28$_L$ respectively.

For example, in FIG. 10, the panel 28 identified as "$P_1$" is positionable in the upper opening A26$_U$ of the narrow frame A22, as indicated by arrow "$Q_1$". Also, the panel 28 identified as "$P_2$" is positionable in the lower opening A26$_L$, as indicated by arrow "$Q_2$". (It will be understood that the panels preferably are mounted to the interior side "I" of the frame A22.)

Preferably, an upper opening B26$_U$ in the second frame B22 is sized to receive a second upper panel B28$_U$ and a lower opening B26$_L$ in the second frame B22 is sized to receive a second lower panel B28$_L$ respectively (FIGS. 8A, 8B).

As an example, in FIG. 8B, the panel 28 identified as "$P_3$" is positionable in the upper opening B26$_U$ of the wide frame B22, as indicated by arrow "$Q_3$". Also, the panel 28 identified as "$P_4$" is positionable in the lower opening B26$_L$, as indicated by arrow "$Q_4$". As noted above, the panels preferably are mounted to the interior side "I" of the frame B22.

In one embodiment, the third frame C22 preferably includes two upper openings C26$_U$', C26$_U$", each of such upper openings being sized to receive the first upper panel A28$_U$ respectively. The two upper openings C26$_U$', C26$_U$" preferably are at least partially defined by a central member 42 and the intermediate cross-member 40 (FIGS. 1C, 2C). As can be seen in FIGS. 1C, 2C, 8A, and 8B, lower opening C26$_L$ in the third frame C22 preferably is sized to receive the second lower panel B28$_L$. That is, and as can be seen in FIGS. 1B and 1C and 2B and 2C, the lower openings B26$_L$, C26$_L$ are the same size.

An example is illustrated in FIG. 8A, in which the panel 28 identified as "$P_5$" is positionable in the left upper opening C26$_U$' of the wide frame C22, and the panel 28 identified as "$P_6$" is positionable in the right upper opening C26$_U$", as indicated by arrows "$Q_5$" and "$Q_6$" respectively. (It will be understood that, as illustrated, each of the panels "$P_5$" and "$P_6$" includes two separate elements.) Also, the panel identified as "$P_7$" is positionable in the lower opening C26$_L$, as indicated by arrow "$Q_7$" in FIG. 8A. As noted above, the panels preferably are mounted to the interior side "I" of the frame C22.

From the foregoing, it can be seen that the three types of frames A22, B22, and C22 provide a degree of standardization, but because the frames include openings of different dimensions, the frames also permit the walls 24 to include a wide variety of panels 28. As noted above, the openings in the first (narrow) frame A22 are formed to receive the first upper and lower panels A28$_U$ and A28$_L$. It will be understood that the two upper openings C26$_U$', C26$_U$" in the third frame C22 are formed to receive two of the first upper panels A28$_U$ respectively.

Similarly, the openings B26$_U$, B26$_L$ in the second frame B22 are formed to receive the second upper and lower panels B28$_U$ and B28$_L$ respectively. It will also be understood that the lower opening C26$_L$ in the third frame C22 is also sized to receive the second lower panel B28$_L$.

In summary, the frames A22, B22, and C22 provide a maximum of four different openings: (i) A26$_U$ (and C26$_U$' and C26$_U$", which are the same size as A26$_U$); (ii) A26$_L$; (iii) B26$_U$; and (iv) B26$_L$ (and C26$_L$, which is the same size as B26$_L$). The panels 28 are configured to fit into these openings. It will be understood that the frames and the panels that are included in any particular kit are those selected by the purchaser.

From the foregoing, it can be seen that, although the different dimensions of the openings provide for a variety of panels, the limited number of openings provides a degree of standardization that helps to keep manufacturing and shipping costs low. In this way, the two seemingly incompatible goals of reducing costs and offering a variety of features and designs are reconciled.

Also, it will be understood that any of the frames A22, B22, C22 may be used without panels secured in any or all of the openings. Examples of this arrangement may be seen, for example, in FIGS. 12, 13, and 15.

It will also be understood that, as noted above, the panel 28 may not necessarily occupy the entire opening 26 in which it is positioned. For example, the body of the panel may take the form of a transom. Examples of panels that occupy only portions of the openings in which they are positioned can be seen in FIGS. 8A, 8B, 10, and 17.

Those skilled in the art would appreciate that the frames may be made of any suitable materials, in any suitable manner. In one embodiment, for example, the frames preferably are made of wood using lap joints that are glued and secured using wood screws.

Those skilled in the art would appreciate that each of the panels 28 may be provided in any suitable form. In one embodiment, the first lower panel A28$_L$ and the first upper panel A28$_U$ and the second lower panel B28$_L$ and the second upper panel B28$_U$ preferably include respective bodies 44 thereof. Also, it is preferred that the first lower panel A$28_L$ and the first upper panel A$28_U$ and the second lower panel B$28_L$ and the second upper panel B$28_U$ include respective side wall flanges 46 that extend from each body 44 respectively over at least a side receiving portion 48 of each of the side walls 34, when the panel is positioned in a selected one of the openings. Preferably, the side wall flanges 46 are securable to the respective side walls 34 by panel fasteners 49, as will be described.

Figure 3A:
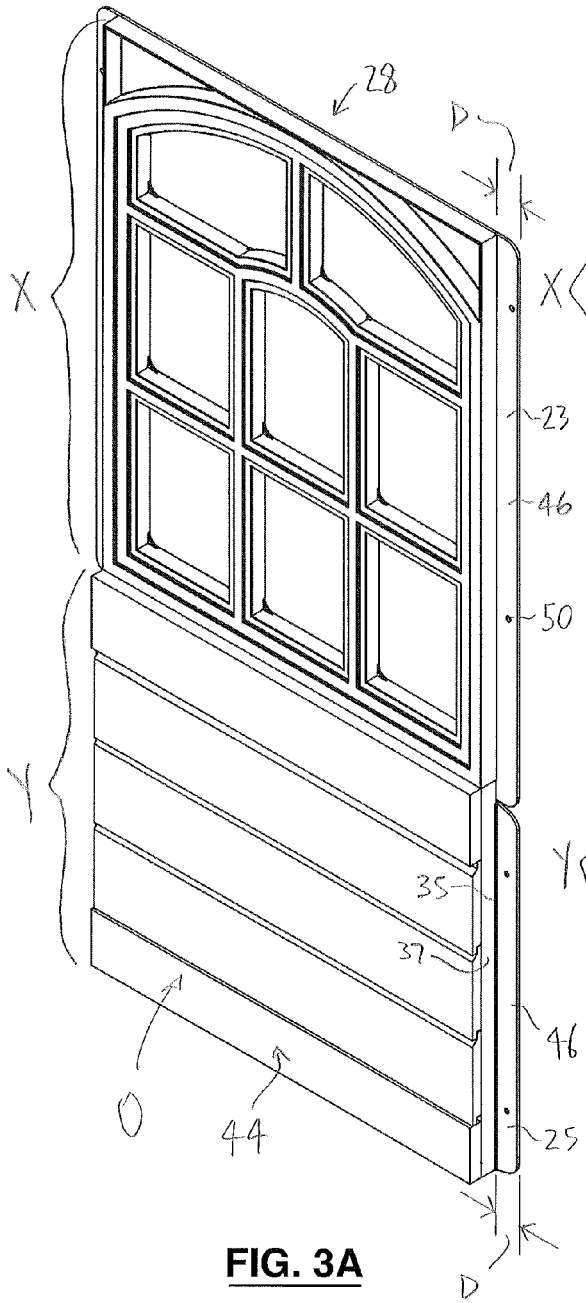
FIG. 3A is an isometric view of an exterior side of an embodiment of a panel of the invention, drawn at a larger scale.
Figure 3B:
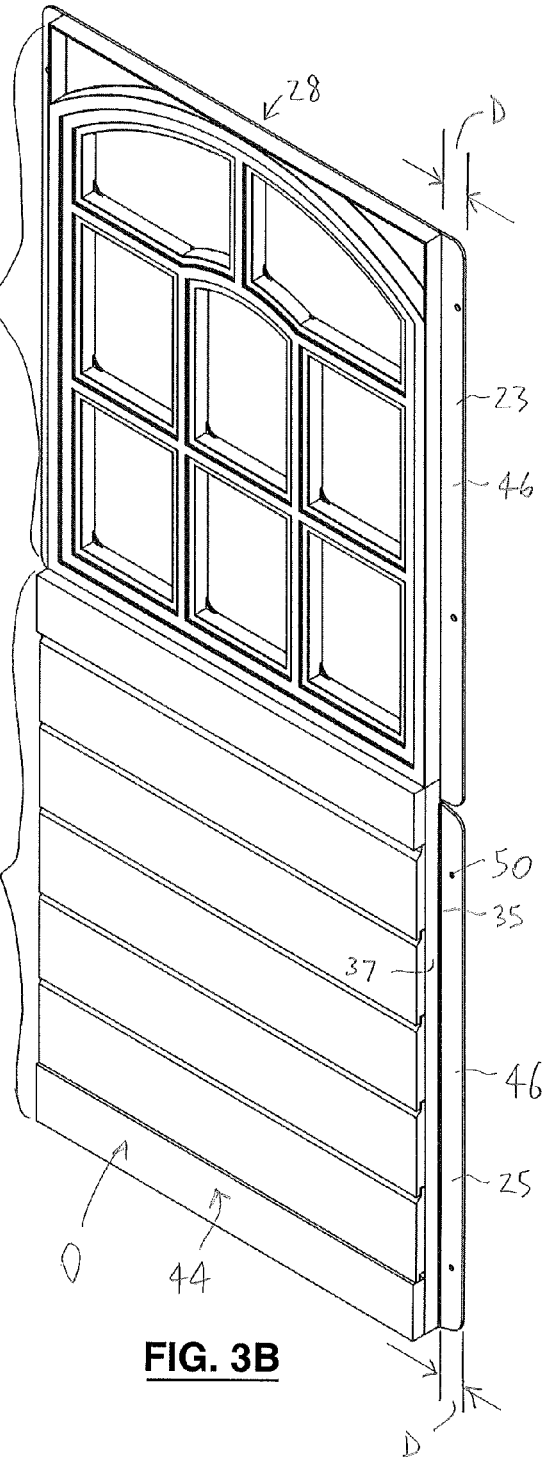
FIG. 3B is an isometric view of an exterior side of another embodiment of the panel of the invention.

It will also be understood that the bodies 44 of the panels 28 may be made of any suitable material or materials. In one embodiment, illustrated in FIGS. 4A and 4B, the body 46 preferably includes a window portion "X" and a solid portion "Y" (FIGS. 3A, 3B). For example, in one embodiment, the solid portion "Y" preferably is formed of wood, and the window portion "X" preferably is formed of a suitable plastic.

Figure 4A:
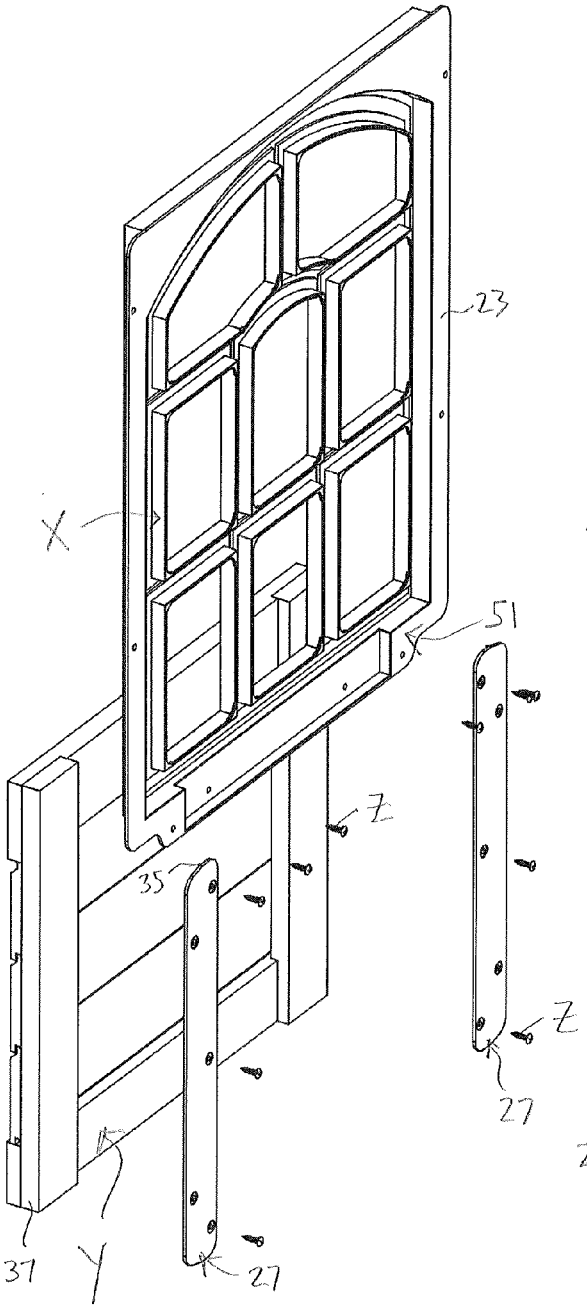
FIG. 4A is an exploded view of an interior side of the panel of FIG. 3A.
Figure 4B:
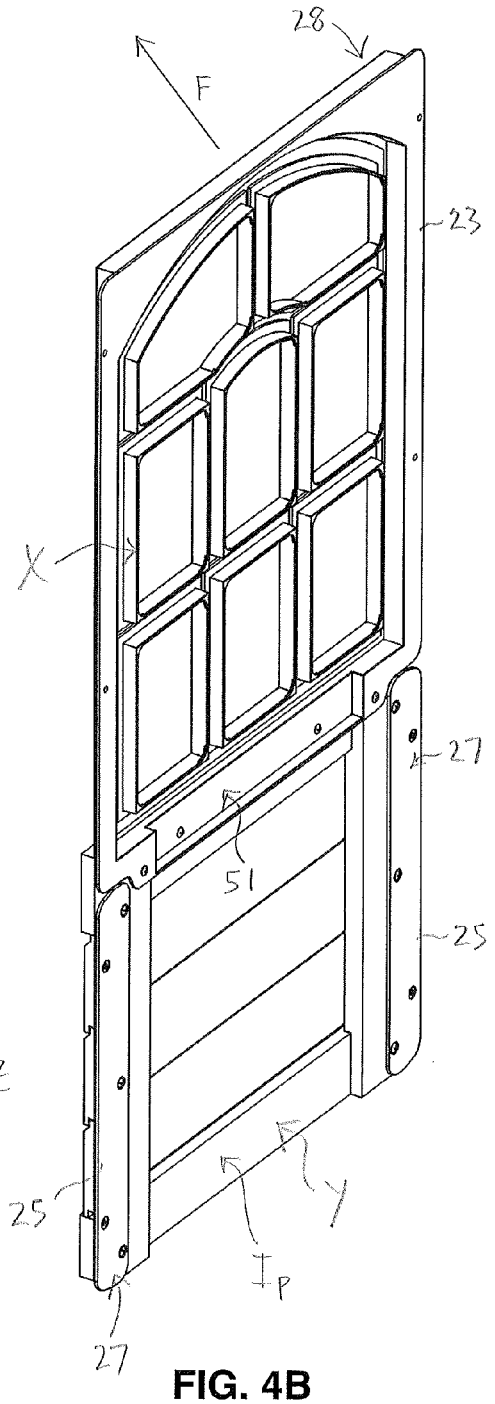
FIG. 4B is an isometric view of an interior side of the panel of FIG. 3A.

It is also preferred that the window portion "X" and the solid portion "Y" are connected to each other, to substantially form the body 44. For instance, in one embodiment, the window portion "X" and the solid portion "Y" preferably are secured to each other by a connecting element 51, which is formed integrally with the window portion "X", and body fasteners "Z", which secure the connection element 51 to the solid portion "Y" (FIGS. 4A, 4B). The body fasteners "Z" may be any suitable fasteners. For instance, it is preferred that the fasteners are suitable screws, which those skilled in the art would be aware of.

Exemplary panels are illustrated in FIGS. 3A-4B. In FIGS. 3A and 3B, outer sides "O" of two exemplary panels are illustrated. An inner side "$I_P$" of one of the panels is illustrated in FIGS. 4A and 4B.

As can be seen in FIGS. 3A, 3B, 4A, and 4B, the flange 46 preferably extends from the body 44 to define a distance "D" that the flange 46 extends from the body (FIGS. 3A, 3B). Preferably, the flange 46 includes holes 50 therein, in which the panel fasteners 49 are receivable, to secure the panel 28 to the frame 22.

It will be understood that, once the panel 28 is assembled, it is moved into the opening selected therefor. Preferably, the outer side "O" of the panel 28 is pushed into the opening 26 to cause the flanges 46 on each side of the panel 28 to engage the interior side "I" of the frame 22. The panel 28 is then secured to the frame 22 by the panel fasteners 49, which preferably are inserted through the holes 50 to engage the side walls 34 of the frame 22, to attach the flanges 46 to the frame 22.

Figure 6B:
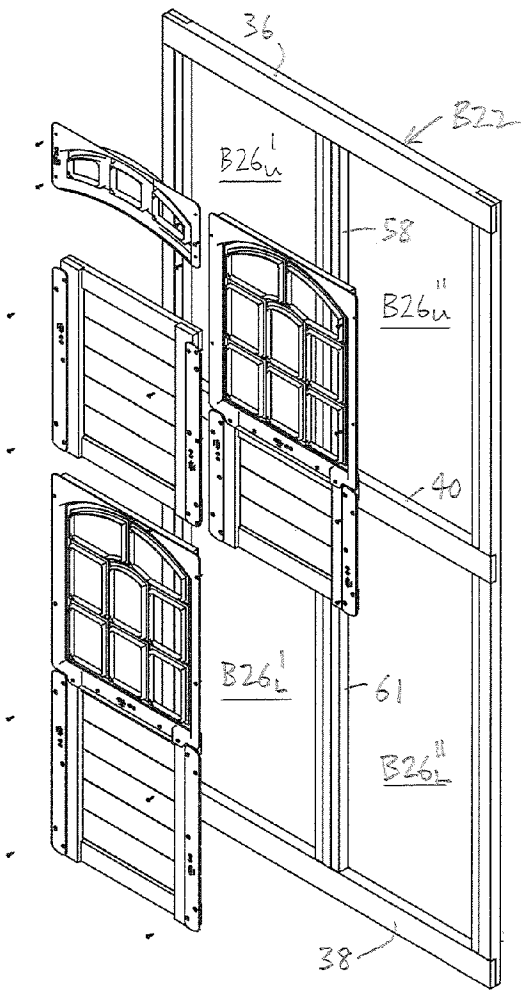
FIG. 6B is an exploded view of an interior side of the frame of FIG. 6A with selected panels positionable in selected openings therein.
Figure 6A:
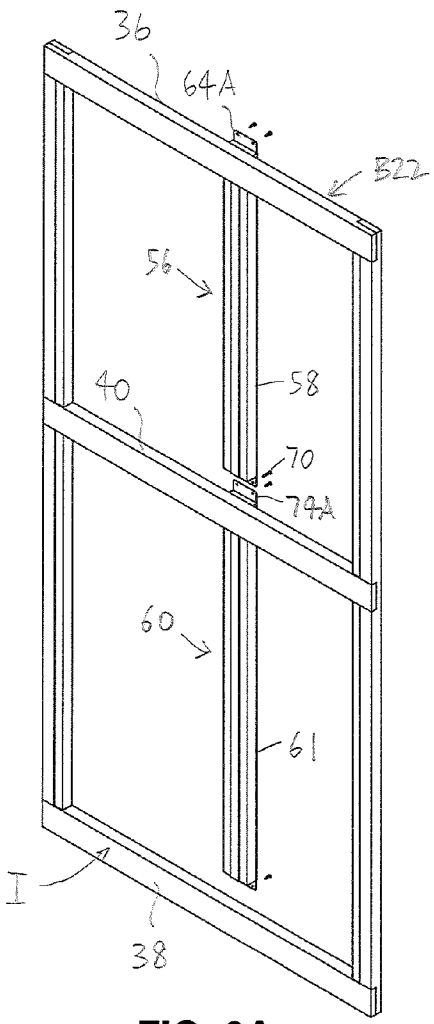
FIG. 6A is an exploded view of an interior side of the frame of FIGS. 1B and 2B and the upper and lower jamb board assemblies, drawn at a smaller scale.
Figure 6D:
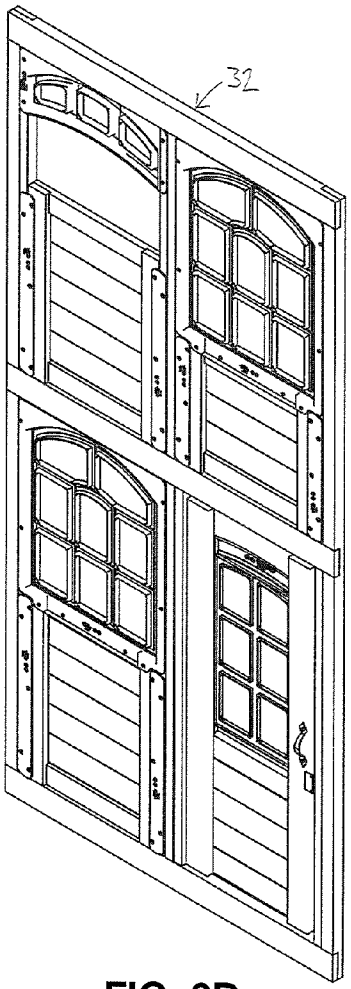
FIG. 6D is an isometric view of an interior side of an embodiment of a wall subassembly of the invention, including the frame and panels of FIG. 6C with the panels secured to the frame.
Figure 6C:
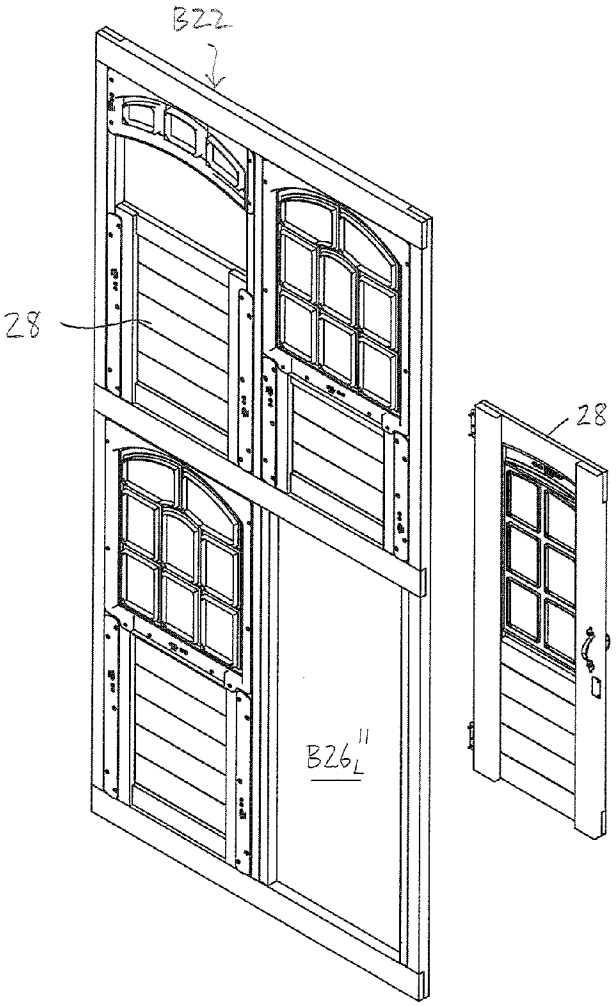
FIG. 6C is an isometric view of an interior side of the frame of FIG. 6B with the panels of FIG. 6B secured thereto and another embodiment of the panel of the invention positionable in another opening therein.
Figure 7A:
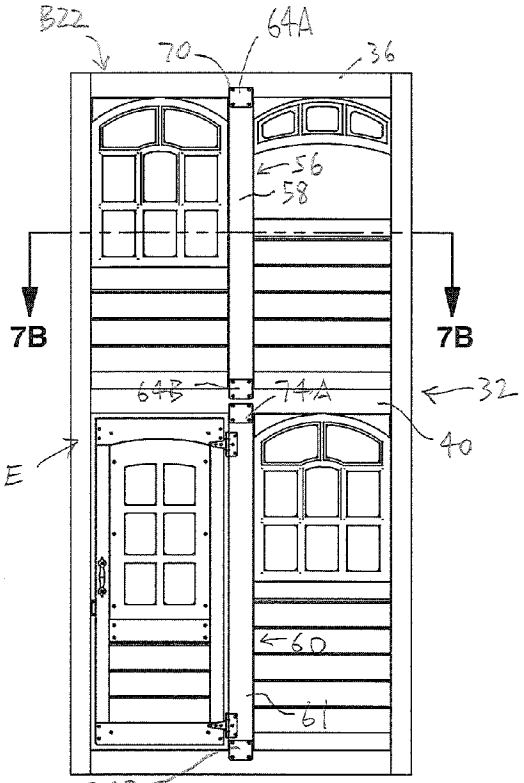
FIG. 7A is a side view of an exterior side of the wall subassembly of FIG. 6D.

The panel fasteners 49 may be any suitable fasteners, e.g., suitable screws (FIGS. 6B-6D). Those skilled in the art would be aware of suitable panel fasteners 49.

Figure 4C:
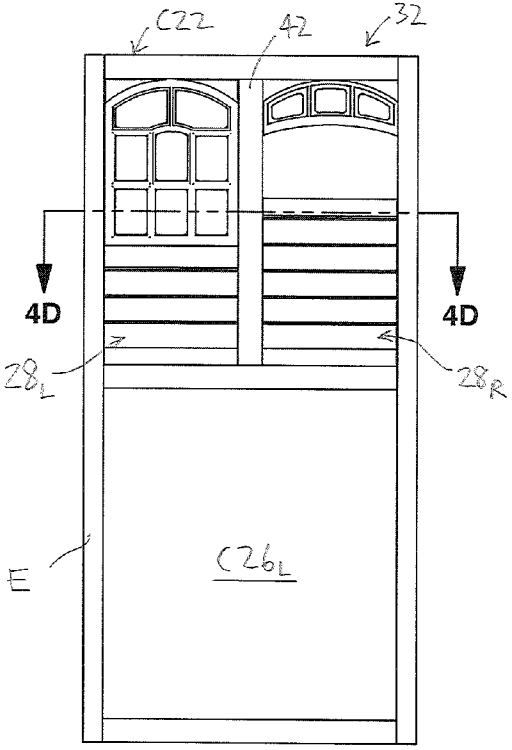
FIG. 4C is an elevation view of an embodiment of a wall subassembly of the invention, drawn at a smaller scale.
Figure 4D:
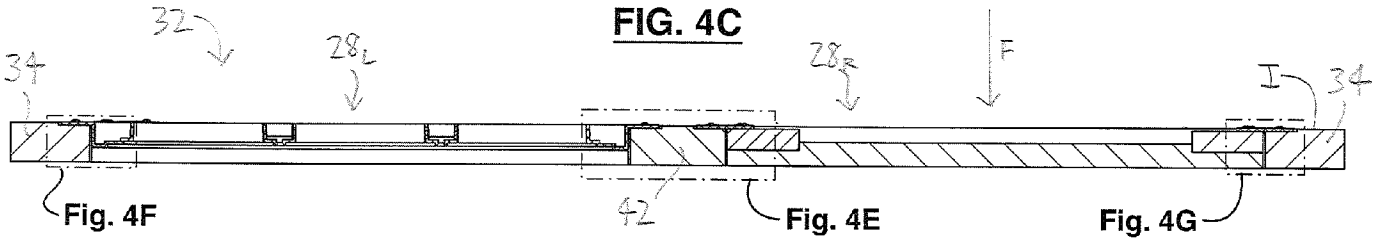
FIG. 4D is a cross-section taken along line 4D-4D in FIG. 4C, drawn at a larger scale.
Figure 7B:
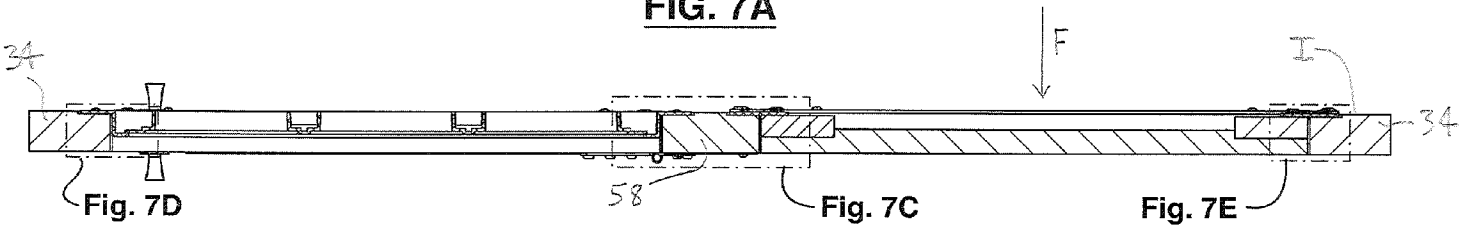
FIG. 7B is a cross-section taken along line 7B-7B in FIG. 7A, drawn at a larger scale.
Figure 7C:
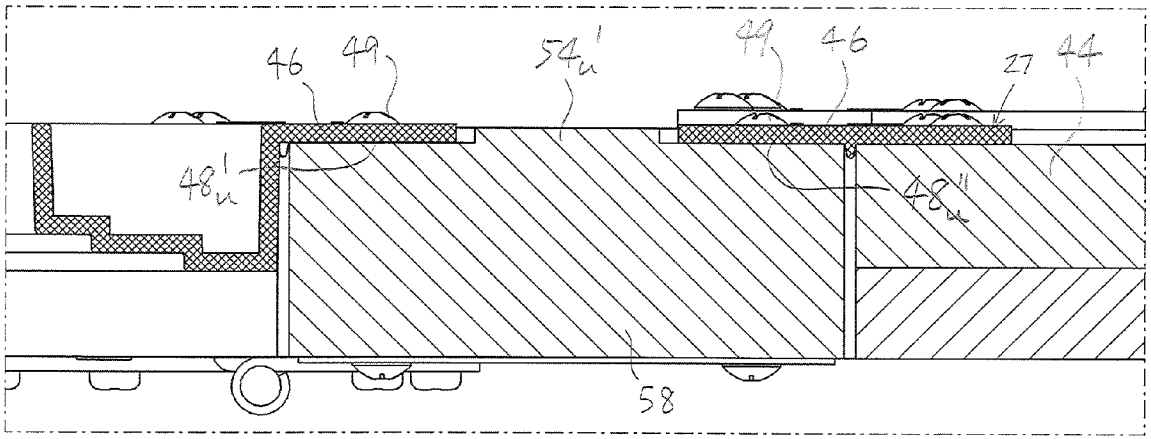
FIG. 7C is a portion of the cross-section of FIG. 7B, drawn at a larger scale.
Figure 8A:
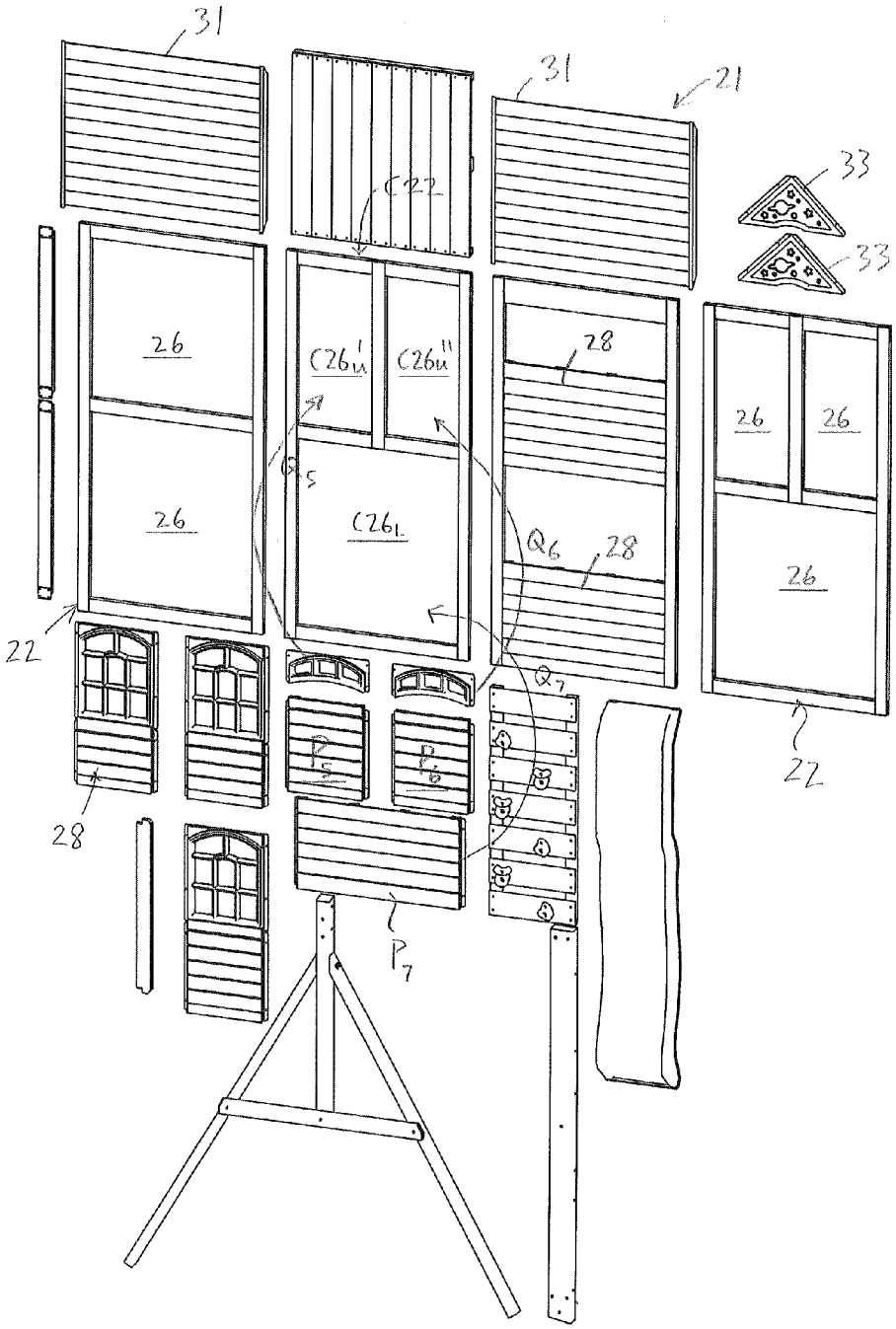
FIG. 8A is an exploded view of components of an embodiment of the play center of the invention.
Figure 8B:
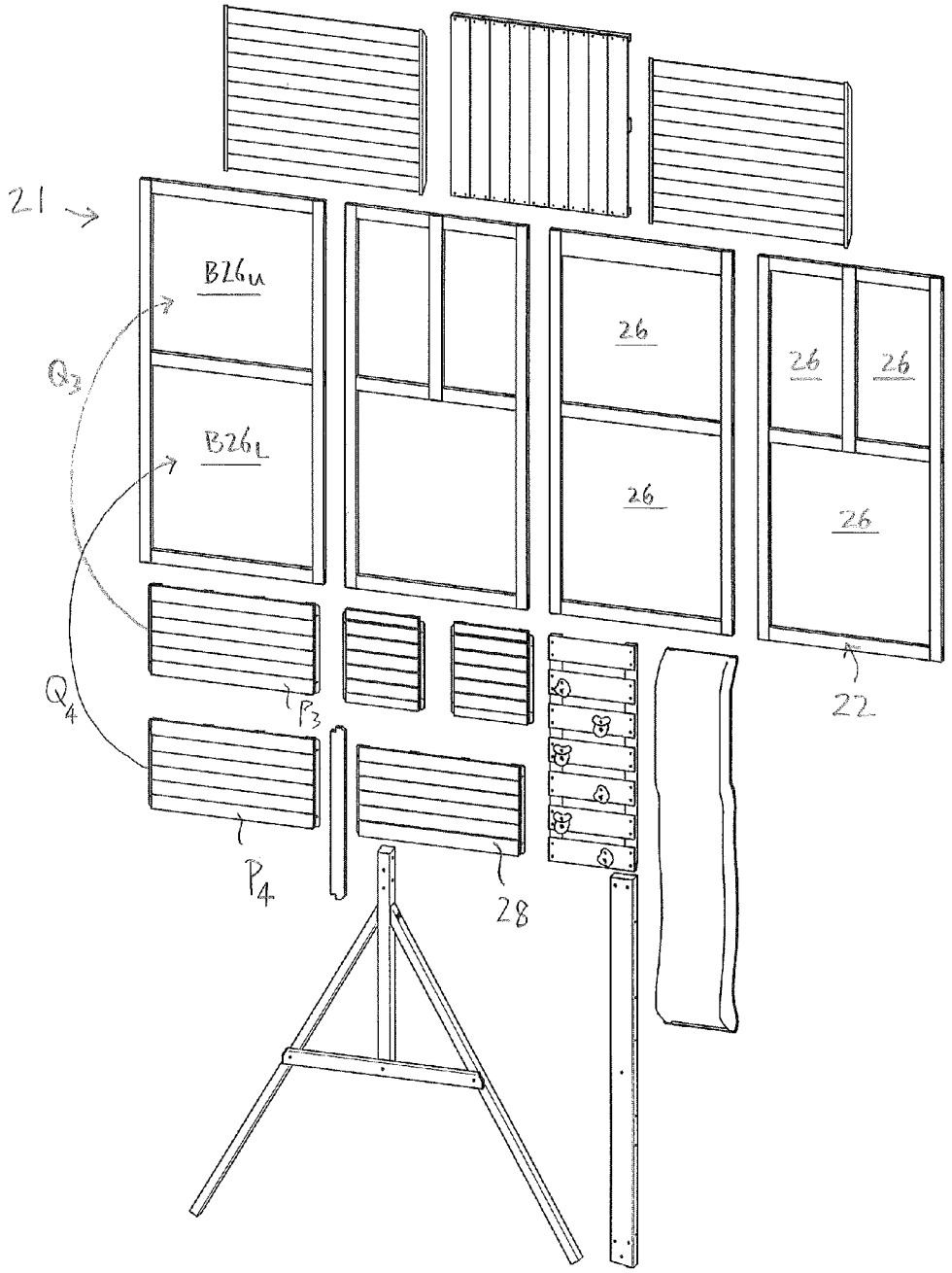
FIG. 8B is an exploded view of the components of another embodiment of the play center of the invention.
Figure 9:
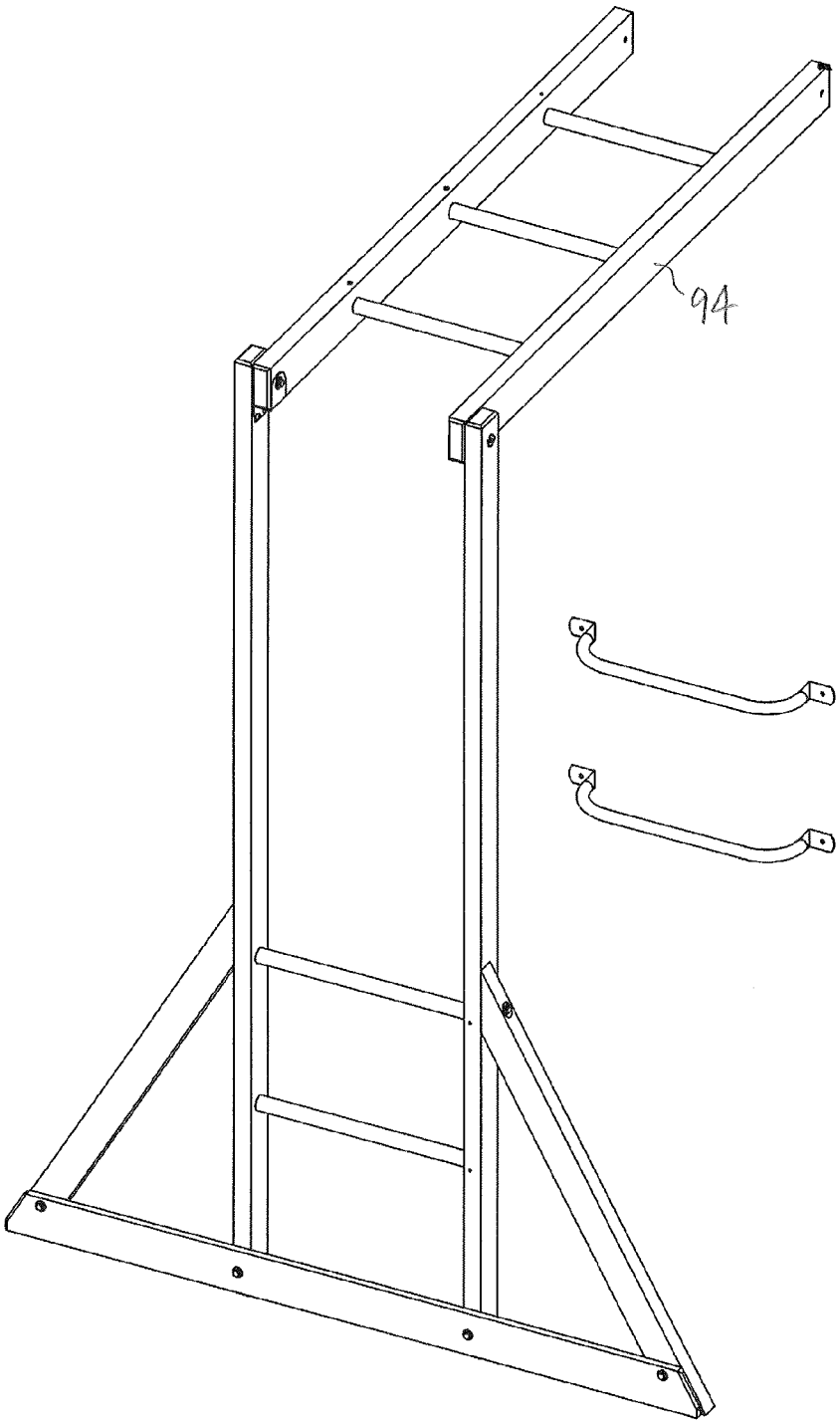
FIG. 9 is an exploded view of a monkey bar subassembly.

The direction of movement of the panel 28 to locate the panel in the opening selected therefor is indicated by arrow "F" (FIGS. 4B, 4D, 7B). Preferably, the panel 28 is moved into the opening, in the direction indicated by arrow "F", until the flanges 46 engage the interior side "I" of the frame 22, i.e., the flanges 46 engage the respective side walls 34 of the frame 22.

It will be understood that the body 44 and the flanges 46 extending therefrom may be made of any suitable materials, formed in any suitable manner. As can be seen in FIGS. 3A-4B, for example, in one embodiment, the flange 46 preferably is formed by side portions 23 of the connecting element 51 and by a part 25 of an elongate element 27. As can be seen, for instance, in FIGS. 4A and 4B, the panel 28 preferably includes two elongate elements 27, i.e., one fastened to each side respectively on the solid portion "Y". Preferably, the elongate elements 27 are secured to the solid portion "Y" by the body fasteners "Z" (FIG. 3A).

Figure 7E:
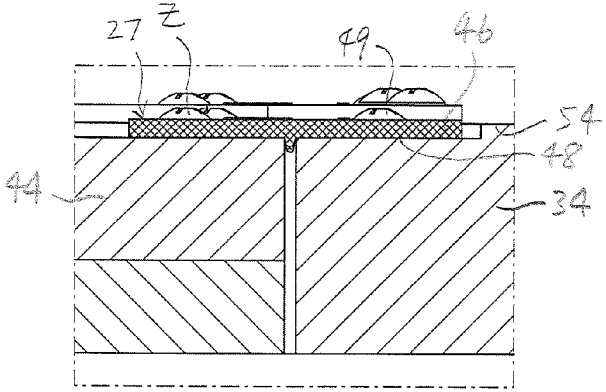
FIG. 7E is another portion of the cross-section of FIG. 7B.
Figure 7D:
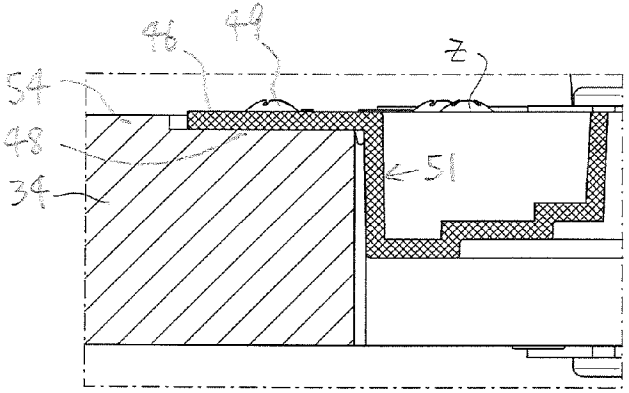
FIG. 7D is another portion of the cross-section of FIG. 7B.

The panel 28 preferably is formed so that the body 44 fits into the opening 26 selected therefor, and when the body 44 is so located, the flange 46 on one side of the panel is positioned on the side receiving portion adjacent thereto (FIG. 7E).

In one embodiment, the side receiving portions 48 of the side walls 34 preferably are located on respective interior sides 52 of the side walls 34. Preferably, each interior side 52 includes one or more proud regions 54 (FIGS. 4F, 4G). It is also preferred that each side receiving portion 48 is recessed relative to the proud region 54 adjacent thereto, as can be seen in FIGS. 4F and 4G.

An exemplary wall subassembly 32 is illustrated in FIGS. 4C-4G. The exterior side of the frame C22, with the panels positioned in the two upper openings of the frame, is shown in FIG. 4C. Also, as illustrated in FIG. 4C, the lower opening C$26_L$ is unoccupied. For clarity of illustration, the panels shown secured in the upper openings of the frame C22 in FIG. 4C are identified as $28_L$ and $28_R$ respectively.

It will be understood that each of the wall subassemblies 32 may include any one of the frames A22, B22, C22. Also, the wall subassembly 32 may include any one or more of the panels (or not), positioned in one or more of the openings in the frame of the wall subassembly 32. The third frame C22 and the panels located in the upper openings thereof as illustrated in FIG. 4C are only one example of the wall subassembly 32.

As can be seen in FIGS. 4C and 4D, the flanges 46 of the panels $28_L$, $28_R$ engage the interior side "I" of the frame C22. As can be seen in FIGS. 4C and 4G, the flange 46 on the outer (right) side of the panel $28_R$ is received on the side receiving portion 48 of the right side wall 34 of the frame C22. The flange 46 on the outer (left) side of the panel $28_L$ is received on the side receiving portion 48 of the left side wall 34 of the frame C22. The flanges 46 on the outer sides of the panels $48_L$, $48_R$ are secured to the respective side receiving portions 48 on the respective side walls 34 by the panel fasteners 49. Each of the side walls 34 preferably includes a proud region 54 adjacent to the receiving portion 48. The proud region 54 preferably is located outwardly relative to the receiving portion (FIGS. 4F, 4G). As can be seen in FIGS. 4F and 4G, when the flange 46 is secured to the receiving portion 48, the flange's exposed surface is substantially flush with an exposed surface of the proud region 54.

Because the frame included in the wall subassembly 32 that is illustrated in FIGS. 4C-4G is the third frame C22, it includes the central member 42, and the flanges 46 on the inner sides of the panels $28_L$, $28_R$ are positioned on respective first and second receiving portions 48', 48" on the central member 42. It will be understood that, in the absence of the lower jamb board subassembly, when a panel is positioned in the lower opening C$26_L$, the flanges of the panel engage the side walls 34. It will also be understood that, when panels are positioned in the openings in the other frames A22, B22, the flanges of the panels engage the side walls of the frames (in the frame B22, in the absence of the upper or lower jamb board subassemblies).

Figure 4E:
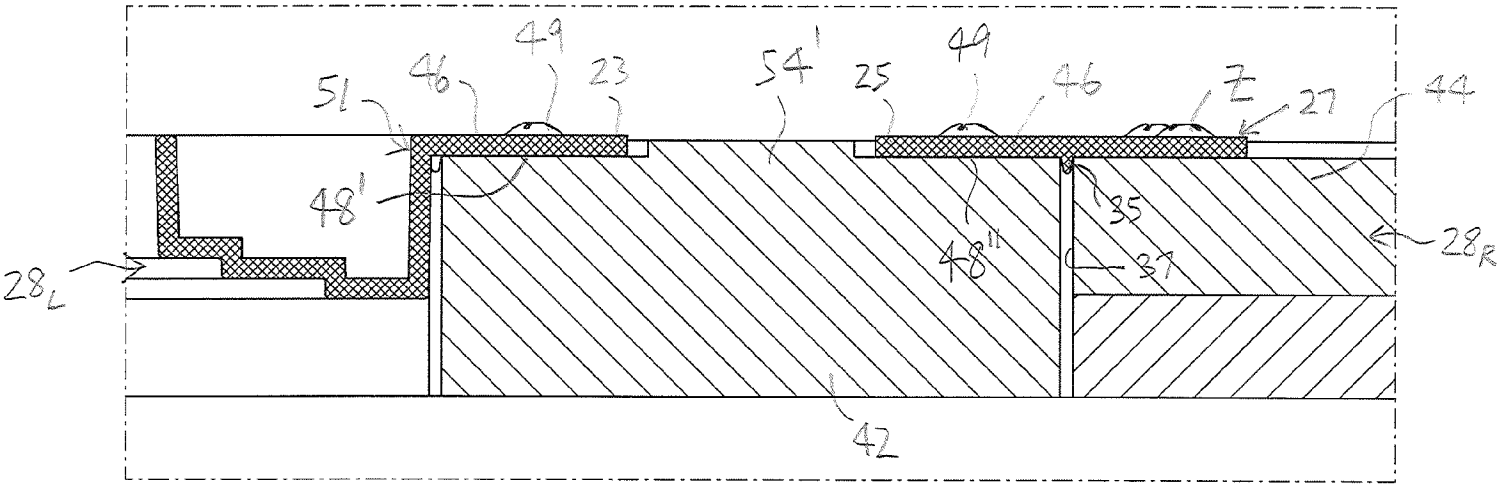
FIG. 4E is a portion of the cross-section of FIG. 4D, drawn at a larger scale.
Figure 4G:
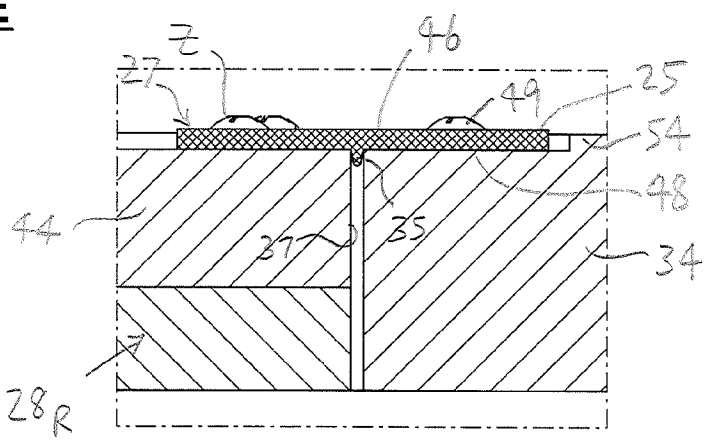
FIG. 4G is another portion of the cross-section of FIG. 4D.
Figure 4F:
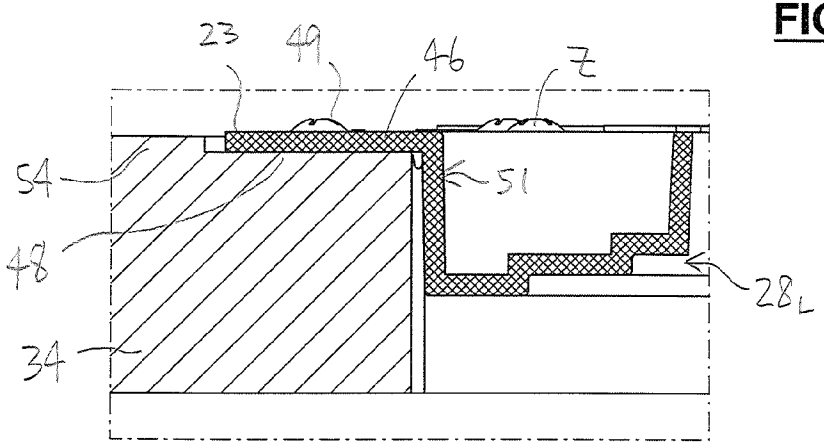
FIG. 4F is another portion of the cross-section of FIG. 4D.

It can be seen in FIG. 4E that the first and second center receiving portions 48', 48" are on the interior side "I" of the central member 42 of the third frame C22. The flange 46 of the left panel $28_L$ is engaged with the first center receiving portion 48', and secured thereto by the panel fasteners 49.

The flange 46 of the right panel $28_R$ is engaged with the second center receiving portion 48", and secured thereto by the panel fasteners 49.

As can be seen in FIGS. 4E and 4G, in one embodiment, the elongate element 27 may include a projection 35, to locate the elongate element 27 properly on the body 44 of the panel 28. For example, when the panel 28 is assembled (as illustrated in FIG. 4A), the elongate element 27 is in its proper position on the body 44 when the projection 35 abuts a side 37 of the body 44 (FIGS. 3A, 3B, 4A, 4E, 4G). Due to the proper positioning of the elongate element 27 on the body 44, the flange 46 has the desired width "D", and is properly positionable on the receiving portion.

The central member 42 preferably also includes a proud region 54' located between the receiving portions 48', 48" that is substantially flush with the flanges 46 that are positioned in the receiving portions 48', 48".

It will be understood that the central member's receiving portions 48', 48" and the proud region 54' function in the same way as the receiving portions 48 and the proud regions 54 of the respective side walls 34.

Figure 5A:
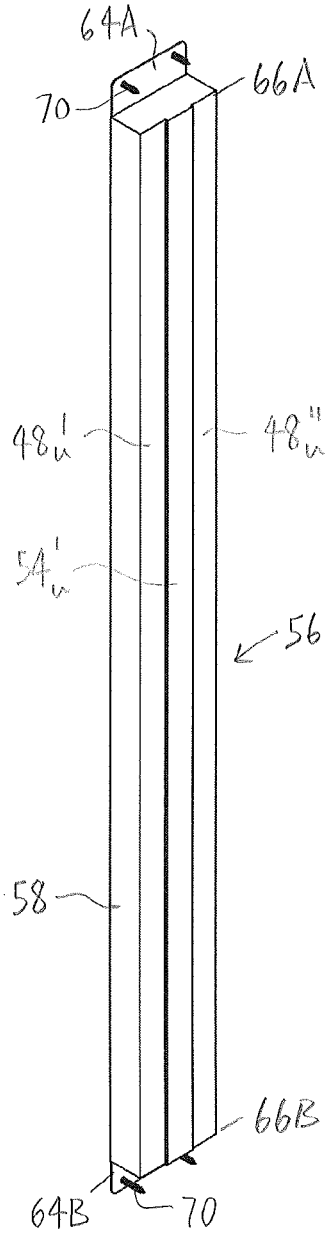
FIG. 5A is an isometric view of an embodiment of an upper jamb board subassembly of the invention, drawn at a larger scale.

From the foregoing, it can be seen that the kit 21 may include such components as are selected by the purchaser, and that the components are formed to be assembled conveniently, in a wide variety of possible arrangements. In order to provide additional play center configuration options for the purchaser, in one embodiment, the play center 20 preferably additionally includes one or more upper jamb board subassemblies 56 (FIG. 5A). Preferably, the upper jamb board assembly 56 includes an upper jamb board 58, for dividing the upper opening $B26_U$ in the second frame B22 into two modified upper openings $B26_U'$, $B26_U''$ (FIGS. 6A, 6B) sized for receiving two of the first upper panels $A28_U$ therein respectively.

Figure 5B:
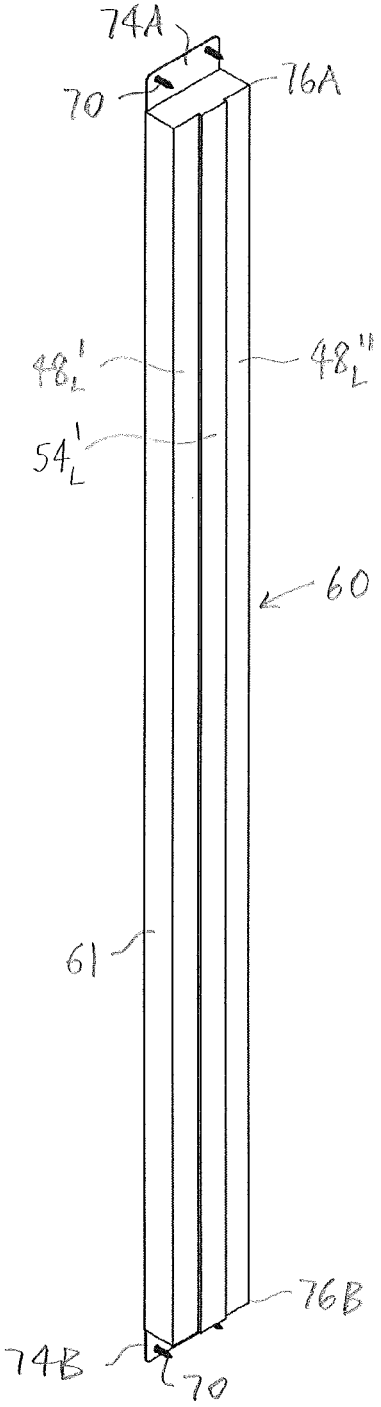
FIG. 5B is an isometric view of an embodiment of a lower jamb board subassembly of the invention.

In another embodiment, the play center 20 preferably additionally includes one or more lower jamb board subassemblies 60 (FIG. 5B). Preferably, the lower jamb board assembly 60 includes a lower jamb board 61, for dividing each of the lower openings $B26_L$, $C26_L$ in the second frame B22 and the third frame C22 respectively into two modified lower openings $B26_L'$, $B26_L''$, and $C26_L'$, $C26_L''$ sized for receiving two of the first lower panels $A28_L$ therein respectively (FIGS. 6A-6D).

The upper and lower jamb board subassemblies 56, 60 are shown installed in the second frame B22 in FIG. 6B. As can be seen in FIG. 6B, once the jamb board subassemblies 56, 60 are installed, the upper jamb board 58 partially defines the modified upper openings $B26_U'$, $B26_U''$, and the lower jamb board 61 partially defines the modified lower openings $B26_L'$, $B26_L''$.

Figure 6E:
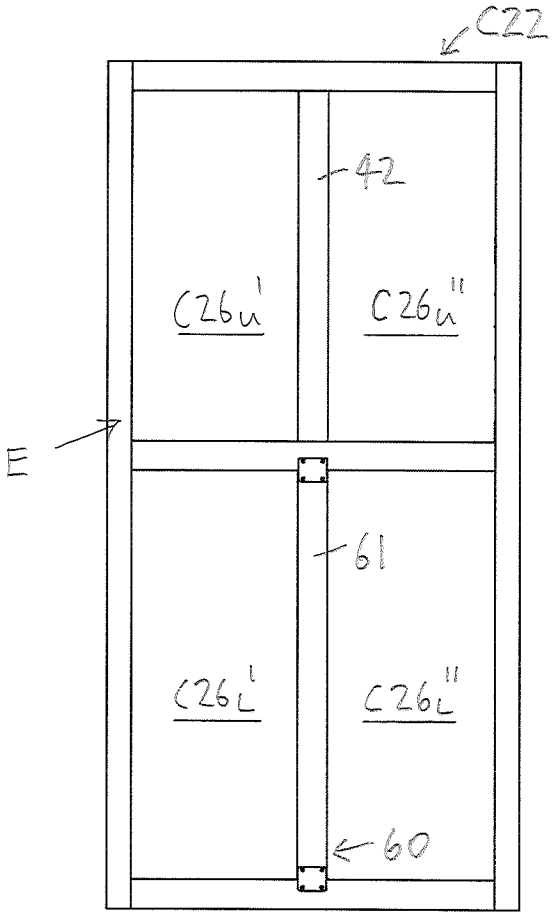
FIG. 6E is an elevation view of the frame of FIGS. 1C and 2C with the lower jamb board subassembly of FIG. 5B mounted thereon, drawn at a smaller scale.

An example of the third frame C22 with the lower jamb board subassembly 60 installed therein is shown in FIG. 6E. As can be seen in FIG. 6E, when the lower jamb board subassembly 60 is installed in the third frame C22, the lower jamb board 61 partially defines the modified lower openings $C26_L'$, $C26_L''$.

It will be understood that the use of the upper and lower jamb board subassemblies 56, 60 is optional. The upper and lower jamb board subassemblies 56, 60 provide the purchaser of the play center 20 with the ability to form smaller openings in the larger frames B22, C22 (as described above), in which smaller panels may be positioned, as may be desired by the purchaser.

As can be seen in FIG. 5A, in one embodiment, the upper jamb board subassembly 56 preferably includes plates 64A, 64B extending from respective ends 66A, 66B of the upper jamb board 58. Preferably, the upper jamb board 58 is formed so that it fits between the top cross-member 36 and the intermediate cross-member 40 of the second frame B22 (FIGS. 6A, 6B).

The interior side "I" of the frame B22 is illustrated in FIGS. 6A-6D, and the exterior side "E" of the frame B22, with panels positioned therein, is illustrated in FIG. 7A. As can be seen in FIGS. 6A, 6B, and 7A, it is preferred that, when the upper jamb board body 62 is positioned between the top cross-member 36 and the intermediate cross-member 40 of the second frame B22, the plates 64A, 64B are located adjacent to the exterior side "E" of the second frame B22. Specifically, the plates 64A, 64B preferably are located proximal to the exteriors of the top cross-member 36 and the intermediate cross-member 40. It is also preferred that the upper jamb board subassembly 56 includes jamb board fasteners 70 to secure the plates 64A, 64B to the top cross-member 36 and the intermediate cross-member 40 respectively (FIGS. 5A, 6A, 7A).

As can be seen in FIG. 5B, in one embodiment, the lower jamb board subassembly 60 preferably includes plates 74A, 74B extending from respective ends 76A, 76B of the lower jamb board 61. Preferably, when used in the second frame B22, the lower jamb board 61 sits between the intermediate cross-member 40 thereof and the bottom cross-member 38 thereof (FIG. 6A).

As noted above, the lower jamb board subassembly 60 may also be installed in the third frame C22. When the lower jamb board subassembly 60 is used with the third frame C22, the lower jamb board 61 is positioned between the intermediate cross-member 40 and the bottom cross-member 38 of the third frame C22 (FIG. 6E).

As can be seen in FIGS. 6A, 6B, and 7A, when the lower jamb board body 61 is positioned between the intermediate cross-member 40 and the bottom cross-member 38, the plates 74A, 74B are located adjacent to the exterior side "E". Specifically, the plates 74A, 74B preferably are located proximal to the exteriors of the intermediate cross-member 40 and the bottom cross-member 38. It is also preferred that the lower jamb board subassembly 60 includes the jamb board fasteners 70 to secure the plates 74A, 74B to the intermediate cross-member 40 and to the bottom cross-member 38 respectively.

As can be seen in FIG. 6E, when the lower jamb board subassembly 60 is installed in the third frame C22, the plates 74A, 74B are secured to the exterior sides of the intermediate cross-member 40 and the bottom cross-member 38.

The plates 64A, 64B, 74A, 74B may be made of any suitable material. It is preferred that the plates are made of a suitable metal. The fasteners 70 preferably are any suitable fasteners. Those skilled in the art would be aware of suitable materials and fasteners.

As can be seen in FIG. 5A, the upper jamb board 58 preferably includes receiving portions $48_U'$, $48_U''$, and a proud region $54_U'$ therebetween. Preferably, and as can be seen in FIG. 5B, the lower jamb board 61 includes receiving portions $48_L'$, $48_L''$ and a proud region $54_L'$ therebetween.

It will be understood that, once the upper jamb board subassembly 56 is secured to the second frame B22, the upper jamb board 58 may be used to at least partially support one or more panels 28 (FIGS. 6B-6D). Similarly, once the lower jamb board subassembly 60 is secured to a selected one of the second and third frames B22, C22, the lower jamb board 61 may be used to at least partially support one or more of the panels 28 (FIGS. 6B-6D). When the first upper panel $A28_U$ is positioned beside an upper central dividing element selected from the group consisting of the upper jamb board 58 and the central member 42, a first selected one of the side wall flanges 46 of the first upper panel A28$_U$ extends from the body 44 of the first upper panel A28$_U$ over the receiving portion of the upper central dividing element, and the first selected one of the side wall flanges 46 is attached to the central dividing element by the panel fasteners 49 (FIGS. 7A-7E).

It will be understood that the flanges 46 are positioned on the receiving portions 48$_L$', 48$_L$" of the lower jamb board 61, and secured thereto by the fasteners 49, in the same way. In one embodiment, when the first lower panel A28$_L$ is positioned beside the lower jamb board 61, a second selected one of the side wall flanges 46 of the first lower panel A28$_L$ extends from the body 44 of the first lower panel A28$_L$ over a lower central receiving portion 80 of the lower jamb board 61, and the second selected one of the side wall flanges 46 is attached to the lower jamb board 61 by the panel fasteners 49.

It will be understood that the bodies 44 of the panels 28 may be provided in any suitable form. For instance, in one embodiment, selected ones of the bodies 46 of the first lower and first upper panels A28$_L$, A28$_U$ and the second lower and second upper panels B28$_L$, B28$_U$ preferably include a solid portion 82 and a window portion 84. It will also be understood, however, that the bodies 46 may be formed of any suitable material, and configured in any suitable manner. For example, the body may entirely consist of the solid portion, or alternatively, of the window portion.

One embodiment of a method of the invention of constructing the play center 20 preferably includes, first, providing a number of the frames 22 securable to each other to at least partially define the substantially vertical walls 24. It is preferred that each of the frames includes one or more upper openings and one or more lower openings. A number of the panels 28 preferably are provided, sized to be received in selected ones of the upper openings and the lower openings respectively. Each of the panels 28 preferably includes the body 44 thereof and one or more flanges extending from the body 44, as described above. It is also preferred that a number of the panel fasteners 49 are provided for securing the flanges 46 to the frames 22, to secure the panels 28 to the frames 22 respectively. Selected ones of the panels preferably are positioned in selected ones of the upper openings and the lower openings in selected ones of the frames 22 respectively to locate the panels 28 in a predetermined arrangement relative to each other, when the frames 22 are secured to each other. Using the panel fasteners 49, the selected ones of the panels 28 preferably are fastened to the selected ones of the frames respectively. Using wall fasteners 30 (FIG. 15), the frames 22 preferably are secured to each other to form substantially vertical walls 24 of the play center 20. Using wall fasteners (FIG. 15), the walls 24 preferably are secured together to form the play center 20. As described above, the predetermined arrangement is determined by the purchaser.

It will be appreciated by those skilled in the art that, although the steps of the method of the invention are described above as taking place in a particular sequence, the sequence in which certain of the steps are performed may not be functionally significant, e.g., the frames may be provided before the panels, or vice versa.

Figure 16:
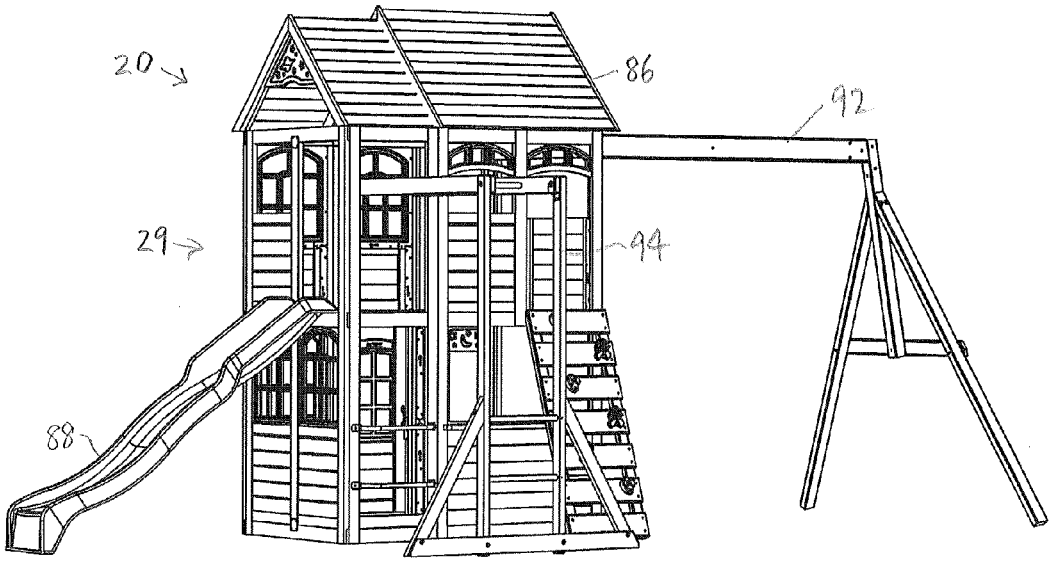
FIG. 16 is an isometric view of another embodiment of the play center of the invention.
Figure 17:
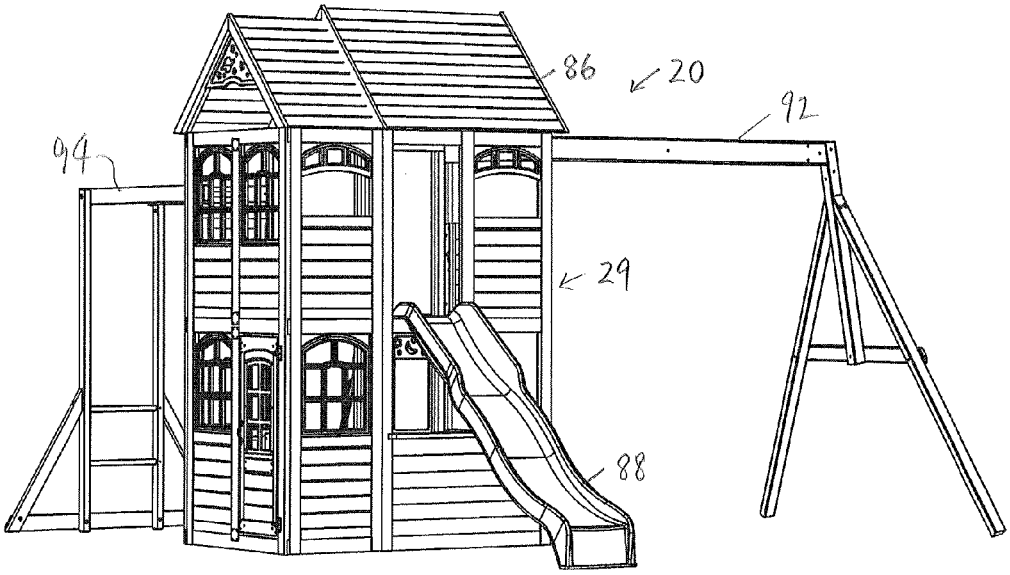
FIG. 17 is an isometric view of another embodiment of the play center of the invention.
Figure 18:
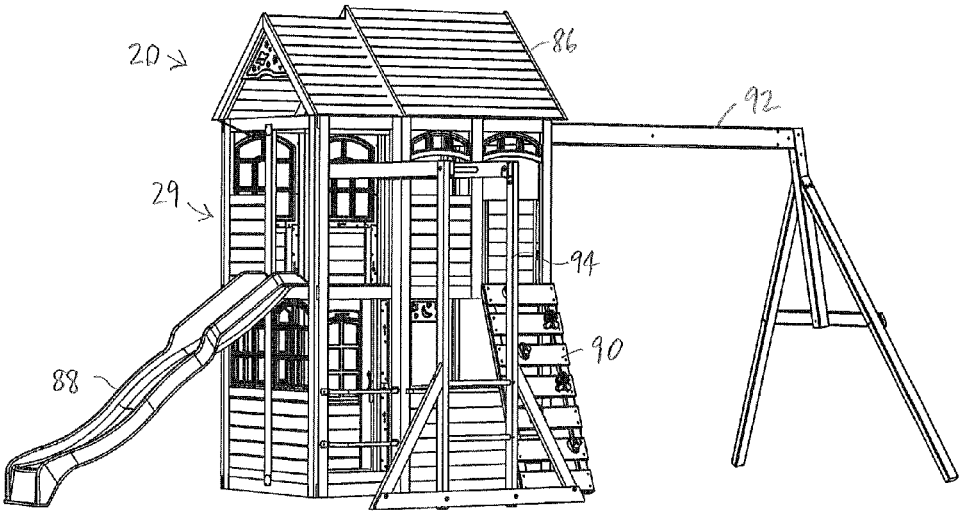
FIG. 18 is an isometric view of another embodiment of the play center of the invention.
Figure 19:
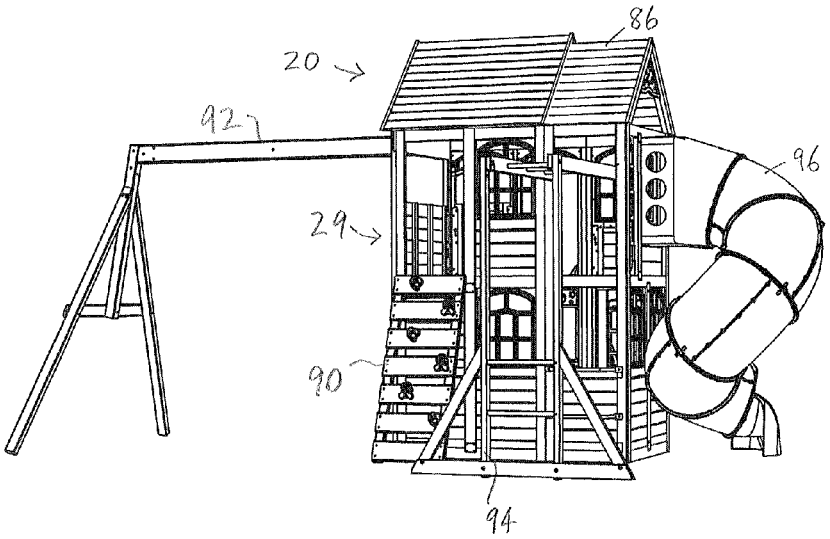
FIG. 19 is an isometric view of another embodiment of the play center of the invention.
Figure 20:
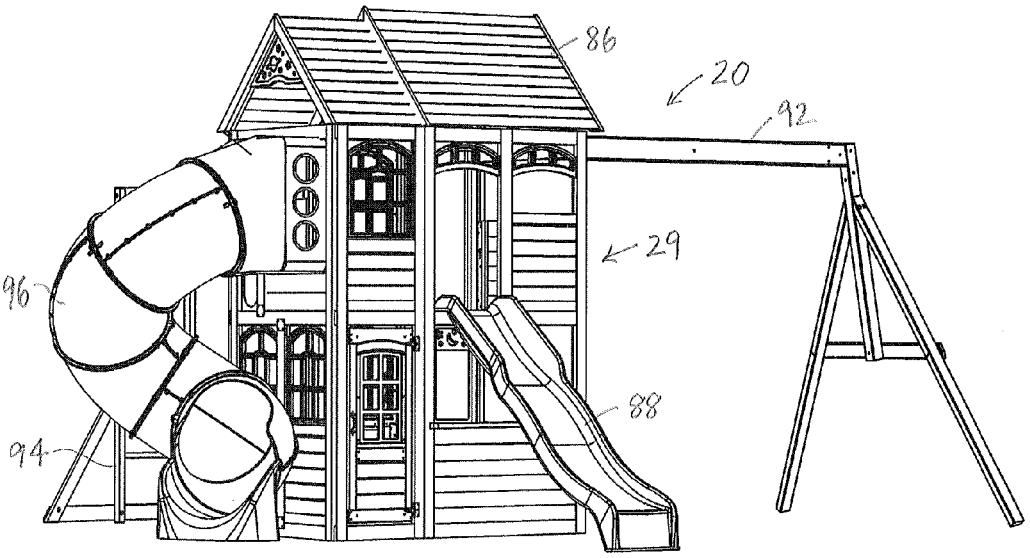
FIG. 20 is an isometric view of another embodiment of the play center of the invention.

Preferably, the play center 20 also includes a number of additional elements, selected by the purchaser, and attached to the main structure 29 of the play center after the walls 24 have been positioned substantially vertically, and attached to each other. It will be understood that these additional elements, as illustrated, are optional. For example, and as can be seen in FIG. 12, the play center 20 may also include a roof 86, a slide 88, a ramp 90, and a swing support 92. The roof 86 may include, for example, roof panels 31 and peak end pieces 33 (FIG. 8A). (It will be understood that the swings are omitted from FIGS. 12-20 for clarity of illustration.) The play center 20 may also optionally include monkey bars 94 (FIGS. 16, 17). An enclosed slide 96 may also be included (FIGS. 11, 19, 20). These optional elements are all securable to the structure 29. The manner in which the additional elements are secured to the main structure 29 is conventional, and therefore does not need to be described in detail.

It will also be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

I claim:

1. A play center comprising:

a plurality of wall subassemblies secured to each other;

a plurality of frames included in the wall subassemblies, each frame of said plurality of frames comprising parallel side walls defining respective left and right sides thereof and top and bottom cross-members defining respective top and bottom ends thereof, each said frame of said plurality of frames having an overall height between the top and bottom ends thereof;

each of the side walls comprising a proud portion and at least one side receiving portion adjacent to the proud portion and recessed relative thereto;

each said frame of said plurality of frames comprising at least two openings therein at least partially defined by an intermediate cross-member of each said frame respectively, said at least two openings comprising at least one upper opening between the intermediate cross-member and the top cross-member, and a lower opening between the intermediate cross-member and the bottom cross-member;

the intermediate cross-member connecting the side walls and being positioned between the top and bottom cross-members;

a plurality of panels, each panel of said plurality of panels comprising a body thereof, the panels being respectively receivable in selected ones of said at least two openings; and each said panel of said plurality of panels comprising at least one side wall flange extending from each said body respectively over said at least one side receiving portion of each of the side walls, said at least one side wall flange being securable to the respective side walls by panel fasteners.

2. A play center according to claim 1 in which:

the panels comprise:

a first upper panel;

a first lower panel;

a second upper panel;

a second lower panel;

the frames comprise:

a first frame having preselected first frame dimensions comprising a first frame outer height between the top and bottom ends thereof, the first frame defining a first frame upper opening and a first frame lower opening separated by the intermediate cross-member thereof sized to receive the first upper panel and the first lower panel respectively;

a second frame having preselected second frame dimensions comprising a second frame outer height between the top and bottom ends thereof, the second frame defining a second frame upper opening and a second frame lower opening separated by the intermediate cross-member sized to receive the second upper panel and the second lower panel respectively;

a third frame having preselected third frame dimensions comprising a third frame outer height between the top and bottom ends thereof, the third frame defining:

two third frame upper openings at least partially defined by a central member, each said third frame upper opening being sized to receive the first upper panel respectively, and a third frame lower opening sized to receive the second lower panel respectively;

the first, second and third frame outer heights being approximately equal.

3. A play center according to claim 2 additionally comprising at least one upper jamb board subassembly comprising an upper jamb board for dividing the second frame upper opening into two modified upper openings sized for receiving two of the first upper panels therein respectively.

4. A play center according to claim 3 in which:

when the modified upper openings are partially defined by said at least one upper jamb board and the first upper panel is received in a selected one of the modified openings, said at least one side wall flange of the first upper panel extends from the body of the first upper panel over an upper central receiving portion of said at least one upper jamb board.

5. A play center according to claim 3 in which the bodies of the first lower panels, the first upper panels, the second lower panels, and the second upper panels each respectively comprise at least one solid portion.

6. A play center according to claim 3 in which the bodies of the first lower panels, the first upper panels, the second lower panels, and the second upper panels comprise at least one window portion.

7. A play center according to claim 3 in which, when the first upper opening is partially defined by a central member comprising at least one upper central receiving portion and the first upper panel is received in the first upper opening, said at least one sidewall flange of the first upper panel extends over said at least one upper central receiving portion of the central member, to which said at least one flange is secured by the fasteners.

8. A play center according to claim 2 additionally comprising at least one lower jamb board subassembly comprising a lower jamb board for dividing a selected one of the second frame lower opening and the third frame lower opening into two modified lower openings sized for receiving two of the first lower panels therein respectively.

9. A play center according to claim 8 in which:

when the modified lower openings are partially defined by said at least one lower jamb board and the first lower panel is received in a selected one of the modified lower openings, said at least one side wall flange of the first lower panel extends from the body of the first lower panel over a lower central receiving portion of said at least one lower jamb board, and said at least one side wall flange is attached to said at least one lower jamb board by the panel fasteners.

10. A play center comprising:

a plurality of frames secured to each other to at least partially define substantially vertical walls of the play center, each frame of said plurality of frames comprising at least two openings;

a plurality of panels, each said panel of said plurality of panels comprising a body thereof, said panels being receivable in selected ones of said at least two openings;

each of said at least two openings being partially defined by at least one elongate side wall of each said frame of said plurality of frames;

each panel of said plurality of panels comprising at least one side wall flange extending from the body thereof over at least a receiving portion on an interior side of said at least one side wall;

the interior side of said at least one side wall comprises at least one proud region adjacent to the receiving portion, the receiving portion being recessed relative to said at least one proud region;

said at least one side wall flange is at least partially receivable on the receiving portion; and a plurality of fasteners for fastening said at least one side wall flange to the receiving portion.

11. A play center according to claim 10 in which:

the panels are provided in preselected sizes; and the frames are formed to define the openings such that selected ones of the panels are received in predetermined ones of the openings.

12. A play center according to claim 10 in which:

each said frame of said plurality of frames comprises two of the elongate side walls connected by top and bottom cross-members defining respective top and bottom ends thereof;

each said frame of said plurality of frames comprises an intermediate cross-member connecting the side walls and positioned between the top and bottom cross-members; and said at least two openings comprise an upper opening between the intermediate and the top cross-members and a lower opening between the intermediate and the bottom cross-members.

13. A play center according to claim 12 in which the frames comprise:

a first frame having preselected first frame dimensions comprising a first frame outer height between the top and bottom ends thereof and a first frame outer width between the side walls thereof;

a second frame having preselected second frame dimensions comprising a second frame outer height between the top and bottom ends thereof and a second frame outer width between the side walls thereof;

a third frame having preselected third frame dimensions comprising a third frame outer height between the top and bottom ends thereof and a third frame outer width between the side walls thereof;

the first, second and third frame outer heights being approximately equal.

14. A play center according to claim 13 in which:

the panels comprise:

a first upper panel;

a first lower panel;

a second upper panel;

a second lower panel;

each said first frame defines a first frame upper opening and a first frame lower opening therein sized to receive the first upper panel and the first lower panel respectively;

each said second frame defines a second frame upper opening therein and a second frame lower opening sized to receive the second upper panel and the second lower panel respectively;

each said third frame defines:

two third frame upper openings at least partially defined by a central member, each said third frame upper opening being sized to receive the first upper panel respectively;

a third frame lower opening sized to receive the second lower panel.

15. A play center according to claim 14 additionally comprising at least one upper jamb board subassembly comprising an upper jamb board for dividing the second frame upper opening in the second frame into two modified upper openings sized for receiving two of the first upper panels respectively.

16. A play center according to claim 15 in which the upper jamb board comprises upper receiving portions and an upper proud region positioned therebetween, the upper receiving portions being formed to receive said at least one side wall flange of the first upper panel.

17. A play center according to claim 14 additionally comprising at least one lower jamb board assembly comprising a lower jamb board for dividing a selected one of the second frame lower opening and the third frame lower opening into two modified lower openings sized for receiving two of the first lower panels respectively.

18. A play center according to claim 17 in which the lower jamb board comprises lower receiving portions and a lower proud region positioned therebetween, the lower receiving portions being formed to receive said at least one side wall flange of the first lower panel.

* * * * *